US010180641B2

(12) United States Patent
Itagaki

(10) Patent No.: US 10,180,641 B2
(45) Date of Patent: Jan. 15, 2019

(54) IMAGE FORMING APPARATUS CONTROLLING CONDITIONS OF APPLIED BIAS BASED ON TEST IMAGE

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/285,776

(22) Filed: Oct. 5, 2016

(65) Prior Publication Data

US 2017/0097593 A1 Apr. 6, 2017

(30) Foreign Application Priority Data

Oct. 6, 2015 (JP) ..... 2015-198727

(51) Int. Cl.
*G03G 15/16* (2006.01)
*G03G 15/00* (2006.01)

(52) U.S. Cl.
CPC ..... *G03G 15/1665* (2013.01); *G03G 15/1675* (2013.01); *G03G 15/5058* (2013.01); *G03G 15/5062* (2013.01); *G03G 15/55* (2013.01); *G03G 2215/00569* (2013.01)

(58) Field of Classification Search
CPC ..... G03G 15/1665; G03G 15/5058; G03G 15/1675
USPC ..... 399/49, 66
See application file for complete search history.

(56) References Cited

U.S. PATENT DOCUMENTS

| | | | | |
|---|---|---|---|---|
| 6,449,444 | B1 | 9/2002 | Tanaka | |
| 8,908,225 | B2 | 12/2014 | Zaima et al. | |
| 8,958,123 | B2 | 2/2015 | Itagaki | |
| 2004/0091277 | A1* | 5/2004 | Miyamoto | G03G 15/1675 399/50 |
| 2014/0133875 | A1* | 5/2014 | Harashima | G03G 15/205 399/49 |

FOREIGN PATENT DOCUMENTS

| | | | |
|---|---|---|---|
| JP | 09-80936 | A | 3/1997 |
| JP | 2001-075378 | A | 3/2001 |
| JP | 2003-131501 | A | 5/2003 |
| JP | 2007-271798 | A | 10/2007 |

OTHER PUBLICATIONS

U.S. Appl. No. 15/189,530, filed Jun. 22, 2016, Tomohisa Itagaki.

* cited by examiner

*Primary Examiner* — Sandra Brase
(74) *Attorney, Agent, or Firm* — Venable LLP

(57) ABSTRACT

An image forming apparatus includes an image bearing member; a toner image forming device; an image transferring device; a transfer bias applying device; an image fixing device; a sensor for detecting light reflected by the toner image fixed on the sheet; a controller for controlling a leading portion bias applied to the leading portion of the sheet with respect to a sheet feeding direction and a central portion bias applied to the central area of the sheet. The controller forms first and second test images on the leading and central portions, respectively, and sets conditions of the leading and central portion biases on the basis of an output of the sensor, in correlation with a kind of the sheet. A toner deposition amount per unit area of the first test image is smaller than that of the second test image.

32 Claims, 12 Drawing Sheets

| ADJUSTMENT | DATA(b) | MIN(b) | MAX(b)-DATA | CHANGE RATIO |
|---|---|---|---|---|
| -10 | -35 | -35 | 55 | 100% |
| -5 | -10 | MAX(b) | 30 | 55% |
| 0 | 8 | 20 | 12 | 22% |
| 5 | 19 | MAX(b)-MIN(b) | 1 | 2% |
| 10 | 20 | 55 | 0 | 0% |

IMAGE FORMING APPARATUS CONTROLLING CONDITIONS OF APPLIED BIAS BASED ON TEST IMAGE

FIELD OF THE INVENTION AND RELATED ART

The present invention relates to an image forming apparatus such as a copying machine, a printer, a facsimile machine, etc., which uses an electrophotographic or electrostatic recording method.

Conventionally, an image forming apparatus which uses an electrophotographic or electrostatic recording method forms a toner image on an image bearing member (first image bearing member), which is an electrophotographic photosensitive member (photosensitive member) or an electrostatically recordable dielectric member, through an optional image formation process. This toner image is directly transferred onto a recording medium, or is temporarily transferred (primary transfer) onto an intermediary transferring member (second image bearing member), and then, is transferred (second transfer) onto the recording medium. As an intermediary transferring member, an endless belt (intermediary transfer belt) is widely in use.

To describe further the process through which an image is formed on recording medium, such as a sheet of paper, by an electrophotographic image forming apparatus of the so-called intermediary transfer type, which is equipped with an intermediary transfer belt, the toner image formed on the photosensitive member is transferred onto the intermediary transfer belt (primary transfer) in the primary transferring portion, and then, is transferred (secondary transfer) onto recording medium such as a sheet of paper. The secondary transferring portion is formed by sandwiching the intermediary transfer belt by a belt suspension roller and a secondary transfer roller. More specifically, a secondary transferring member, for example, a secondary transfer roller, is positioned so that it opposes one of the rollers by which the intermediary transfer belt is suspended and kept tensioned, with the presence of the intermediary transfer belt between the secondary transfer roller and the belt suspending/tensioning roller. As voltage is applied to the secondary transferring member or belt suspending/tensioning roller, an electric field is generated in the secondary transferring portion, whereby the toner image on the intermediary transfer belt is transferred (secondary transfer) onto the recording medium supplied to the secondary transferring portion.

If the electric field generated in the secondary transferring portion is too strong, the following phenomenon sometimes occurs. That is, the toner particles in the toner image are given, by electric discharge, such electric charge that is opposite in polarity from the normal toner charge. Thus, the toner particles reduce in electric charge close to zero. Thus, they fail to be transferred onto the recording medium. Therefore, the resultant image has unwanted white blemishes, which correspond in position to the portions of the recording medium which were subjected to the electrical discharge. The stronger the electric field formed in the secondary transferring portion, the more likely it is for this phenomenon to occur. Thus, this phenomenon is referred to as "transfer blemish".

It is when the electric field generated in the secondary transferring portion is too strong that the "transfer blemish" is likely to occur. Therefore, it is thought that the "transfer blemish" can be prevented by minimizing the transfer voltage to be supplied for the secondary transfer. However, if the transfer voltage is made too small, it becomes impossible for the toner particles in a high density image to be entirely transferred onto recording medium. Thus, as the high density toner image on the intermediary transfer belt is transferred onto recording medium, it sometimes loses its quality.

The electric discharge which causes "transfer blemish" in the adjacencies of the secondary transferring portion is likely to occur if there are gaps (discharge gaps) between the surface of the intermediary transfer belt, on which a toner image is borne, and the surface of a sheet of recording medium, onto which the toner image is transferred. Further, the abovementioned gaps are likely to occur if the intermediary transfer belt is vibrating in the adjacencies of the secondary transferring portion. Therefore, the "transfer blemish" is likely to occur when a sheet of paper, for example, which is relatively high in rigidity, is used as the recording medium. For example, it is when a sheet of cardstock is used as the recording medium that the "transfer blemish" is likely to occur. More specifically, the "transfer blemish" is likely to occur when the leading edge of a sheet of recording edge enters the adjacencies of the secondary transferring portion. Further, the "transfer blemish" is likely to occur when the trailing edge of a sheet of cardstock, for example, disengages from a conveyance guide for guiding the sheet of recording medium to the secondary transferring portion. That is, the "transfer blemish" is likely to occur when the leading or trailing edge of a sheet of recording medium is in the adjacencies of the secondary transferring portion. By the way, such terminologies such the leading edge (inclusive of its adjacencies) and trailing edge (inclusive of its adjacencies) of a sheet of recording medium, and the center portion (inclusive of its adjacencies) of the sheet of recording medium, are used with reference to the direction in which the sheet of recording medium is conveyed, unless specifically noted.

Thus, it has been proposed to make the transfer current supplied to the leading and trailing edge portions of a sheet recording medium, different from the transfer current supplied to the center portion of the sheet (Japanese Laid-open Patent Application No. H09-80936). It is also proposed to make the transfer voltage to be applied to the center portion of a sheet of recording medium, different (weaker) from the transfer voltage to be applied to the trailing portion of the sheet, and change the timing with which the transfer voltage is to be changed (weakened), according to recording medium type (Japanese Laid-open Patent Application No. 2001-75378).

However, if transfer bias is changed based on whether the leading edge portion, center portion, or trailing edge portion of a sheet of recording medium is in the secondary transferring portion or its adjacencies, the operation for setting transfer bias becomes very complicated, because the transfer bias has to be set for each of various types of recording medium.

Next, referring to FIG. 12, the conditions which require that the secondary transfer bias to be applied to the leading and trailing portions of a sheet of recording medium is weaker (smaller in absolute value) are described. By the way, the secondary transfer bias to be applied to the leading and trailing portions of a sheet of recording medium, which is weaker than that to be applied to the center portion of the sheet, may be referred to as "leading edge portion bias (or leading edge portion weak bias)", and "trailing edge portion bias (or trailing edge portion weak bias)". Further, the secondary transfer bias to be applied to the center portion of a sheet of recording medium, which is stronger (greater in absolute value) than at least one of the leading edge portion bias and trailing edge portion bias, may be referred to as "center portion bias (or center portion normal bias)".

The horizontal axis of FIG. 12 represents the position of a sheet of recording medium in terms of the direction in which the sheet is conveyed through the secondary transferring portion. In FIG. 12, the left side corresponds to the leading edge of a sheet of recording medium, whereas the right side corresponds to the trailing edge of the sheet. The vertical axis of FIG. 12 represents the value of the secondary transfer bias. The higher it is, the stronger the secondary transfer bias. FIG. 12 shows the transition of the secondary transfer bias, which occurs as a sheet of recording medium is moved through the secondary transferring portion. Further, the solid line in FIG. 12 corresponds to when the leading edge portion bias and trailing edge portion bias are not set, whereas the broken line corresponds to when the leading edge portion bias and trailing edge portion bias are set.

The conditions (parameters) which are desired to be set according to recording medium type are the following five:

Value for leading edge portion bias

Point (timing) at which the application of leading edge portion bias is to be ended Value for center portion bias Point (timing) at which the application of trailing edge portion bias is to be started Value for trailing edge portion bias.

It used to take no less than 30 minutes even for an experience person to set these five conditions by repeating a process of printing test images (patterns) and adjusting the apparatus.

Further, it is desired that the leading edge portion bias and trailing edge portion bias are changed according to the center portion bias. Therefore, the process for setting optimal values for the abovementioned conditions (parameters) has been a very difficult adjustment process to an inexperienced operator.

SUMMARY OF THE INVENTION

Thus, the primary object of the present invention is to provide an image forming apparatus structured so that it can allow an operator to individually control each of the transfer biases which are different in terms of the portion of a sheet of recording medium to which they are to be applied, in terms of the recording medium conveyance direction, and also, can enable an operator to easily set the transfer bias according to recording medium type, or an image forming apparatus which can enable its operator to easily set transfer bias for the leading edge portion bias and/or trailing edge portion bias in terms of the recording medium conveyance direction.

According to an aspect of the present invention, there is provided an image forming apparatus comprising an image bearing member configured to carry a toner image; a toner image forming device capable of forming a toner image on said image bearing member; a transferring device configured to transfer the toner image from said image bearing member onto a recording material at a transfer portion; a transfer bias applying device configured to apply a transfer bias for transferring the toner image onto the recording material passing through the transfer portion; a fixing device configured to fix the toner image transferred onto the recording material, on the recording material; a sensor configured to detect light projected to and reflected by the toner image fixed on the recording material by said fixing device; and a controller configured to control a leading end bias applied to the leading end side area of the recording material with respect to a feeding direction and a central portion bias applied to the central area of the recording material between the leading end side area and a trailing end side area with respect to the feeding direction, wherein said controller controls said image forming apparatus to form first and second test images on the leading end side area and on the central area, respectively, and sets conditions of the leading end bias and the central portion bias on the basis of results of detection by said sensor, in correlation with a kind of the recording material, and wherein a toner deposition amount per unit area of the first test image formed on the leading end portion is smaller than that of the second test image formed on the central portion.

Further features of the present invention will become apparent from the following description of exemplary embodiments with reference to the attached drawings.

DESCRIPTION OF THE EMBODIMENTS

Hereinafter, the image forming apparatus in accordance with the present invention is described in greater detail with reference to the appended drawings.

Embodiment 1

1. Overall Structure and Operation of Image Forming Apparatus

Figure 1:
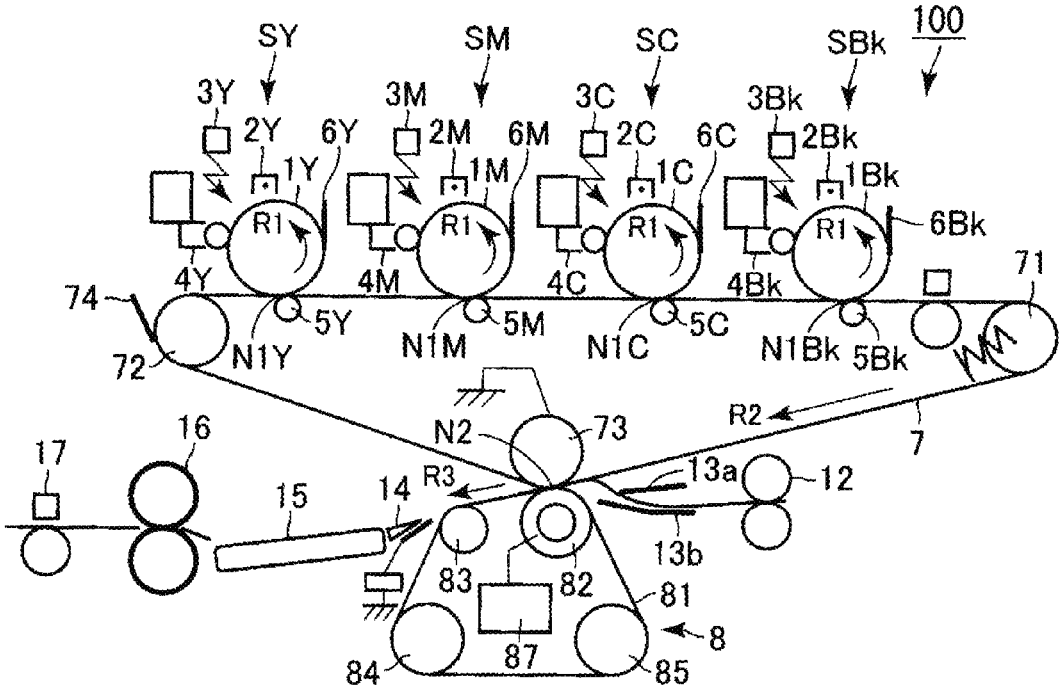
FIG. 1 is a schematic sectional view of a typical image forming apparatus to which the present invention is applicable.

FIG. 1 is a schematic sectional view of the image forming apparatus 100 in the first embodiment of the present invention. The image forming apparatus 100 in this embodiment is a multifunction image forming apparatus of the so-called intermediary transfer type, and also, of the so-called tandem type. It is capable of functioning as a copying machine, a printer, a facsimile machine, etc. It is capable of forming a full-color image with the use of an electrophotographic image forming method.

The image forming apparatus 100 has multiple image forming portions (stations), that is, the first, second, third, and fourth image forming portions SY, SM, SC and SBk which form yellow (Y), magenta (M), cyan (C) and black (Bk) images, respectively. In this embodiment, these four image forming portions SY, SM, SC and SBk are practically the same in structure and operation, although they are different in the color of the toner they use in their development process, which will be described later. Thus, the suffixes Y, M, C and Bk which indicate the color of the toner they use, are omitted to describe the image forming portions together, unless they need to be differentiated.

The image forming portion S has a photosensitive drum 1 which is a rotatable electrophotographic photosensitive member (photosensitive member). The photosensitive drum 1 is rotationally driven in the direction indicated by an arrow mark R1 in FIG. 1. In the image forming portion S, the following processing devices are disposed in the adjacencies of the peripheral surface of the photosensitive drum 1, in the order in which they will be listed next, in terms of the rotational direction of the photosensitive drum 1. The first one is a charging device 2 as a charging means. The next one is an exposing device 3 (laser scanner) as an exposing means. The third one is a developing device 4 as a developing means. The fourth one is a primary transfer roller 5 as a primary transferring member as the first transferring means. The fifth one is a drum cleaning member 6 as a photosensitive member cleaning means.

As the photosensitive drum 1 is rotated, its peripheral surface is roughly uniformly charged to preset polarity (negative in this embodiment) and potential level by the charging device 2. Then, the charged peripheral surface of the photosensitive drum 1 is exposed by the exposing device 3 according to the image information. Consequently, an electrostatic latent image (electrostatic image) which reflects the image information is effected on the photosensitive drum 1. The electrostatic latent image formed on the photosensitive drum 1 is developed into a visible image by the developing device 4 which uses toner. Consequently, a toner image is formed on the photosensitive drum 1. In this embodiment, the reversal developing method is used. That is, as the uniformly charged peripheral surface of the photosensitive drum 1 is exposed, the exposed points of the peripheral surface of the photosensitive drum 1 reduce in potential (in absolute value). It is to these points, which are reduced in potential, that toner adheres. In this embodiment, the electrical charge which toner has during development is negative (normal).

By the way, the electrostatic latent image formed by the exposing device 3 is a collection of small dots. Thus, a toner image to be formed on the photosensitive drum 1 can be changed in density by changing the toner image in dot density. In this embodiment, the maximum density of each of toner images of various colors is in a range of 1.5-1.7 in terms of the density measured with the use of X-Rite 500 series Status A (Bk is Visual) (product of X-Rite Co., Ltd.). The amount by which toner is borne by a sheet of recording medium when the image forming apparatus 100 is set to the highest level of density is roughly in a range of 0.4-0.6 $mg/cm^2$.

The image forming apparatus 100 is provided with an intermediary transfer belt 7 as the second image bearing member, which is a rotationally (circularly) movable endless belt, and which is disposed so that it contacts the peripheral surface of each of the photosensitive drums 1Y, 1M, 1C and 1Bk, in the image forming portions SY, SM, SC and SBk, respectively. The intermediary transfer belt 7 is suspended and kept tensioned by multiple belt suspending-tensioning rollers, more specifically, a tension roller 71, a driver roller 72, and a belt-backing roller 73 (which opposes secondary transfer roller 82, which will be described later). The tension roller 71 keeps the intermediary transfer belt 7 stable in tension at a preset level. The driver roller 72 moves (rotates) the intermediary transfer belt by transmitting to the intermediary transfer belt 7, the driving force from a belt driving motor (unshown) as a driving means. The intermediary transfer belt 7 is rotationally driven by the driver roller 72 in the direction indicated by an arrow mark R2 in FIG. 1. In this embodiment, the peripheral velocity of the intermediary transfer belt 7 is 250-300 mm/sec. The tension roller 71 is under the pressure (force) generated by springs as pressure (force) applying means in the direction to push the intermediary transfer belt 7 from within the loop which the intermediary transfer belt 7 forms, outward of the loop. In this embodiment, the intermediary transfer belt 7 is provided with roughly 2-5 kg of tension by this force, in terms of the direction in which the intermediary transfer belt 7 is conveyed. The belt-backing roller 73 forms the secondary transferring portion N2 (secondary transfer nip) by being disposed in a manner to oppose the secondary transfer roller 82, which will be described later, with the presence of the intermediary transfer belt 7, and the secondary transfer belt 81, which also will be described later, between itself and secondary transfer roller 81. The intermediary transfer belt 7 is an example of image bearing member (second image bearing member) which bears a toner image, and conveys the toner image to the transferring portion (secondary transferring portion) for transferring the toner image onto a sheet of recording medium.

In this embodiment, an endless belt having three layers, more specifically, a resin layer, an elastic layer, and a surface layer, listing from the inward side of the belt loop, is used as the intermediary transfer belt 7. As the resinous material for forming the resin layer, polyimide, polycarbonate, or the like substance is used. The thickness of the resin layer is roughly 70-100 μm. As the elastic material for forming the elastic layer, urethane rubber, chloroprene, or the like is used. The thickness of the elastic layer is roughly 200-250 μm. From the standpoint of making it easier for the toner to transfer onto a sheet P of recording medium, in the secondary transferring portion, the material for the surface layer is desired to be such a substance that can reduce the surface of the intermediary transfer belt 7 in the amount of force by which toner is made to adhere to the surface. For example, polyurethane or the like resinous substance, or an elastic substance such as rubber, elastomer, can be used as the material for the intermediary transfer belt 7. By the way, the thickness of the surface layer is desired to be roughly 5-10 μm. Further, to the material for the intermediary transfer belt 7, an electrically conductive agent such as carbon black is added to adjust the volume resistivity of the intermediary transfer belt 7 to roughly $1\times10^{9}$-$1\times10^{14}$ Ω·cm.

There are disposed the abovementioned primary rollers 5Y, 5M, 5C and 5Bk, on the inward side of the loop which the intermediary transfer belt 7 forms, in such a manner that they oppose the photosensitive drums 1 one for one. Each primary transfer roller 5 is kept pressed toward the photosensitive drum 1, forming thereby the primary transferring portion N1 (primary transfer nip), which is the area of contact between the intermediary transfer belt 7 and photosensitive drum 1. On the outward side of the intermediary transfer belt 7 in terms of the belt loop, a secondary transferring device 8 is disposed as the secondary transferring means, in such a manner that it opposes the aforementioned belt-backing roller 73. The secondary transferring device 8 has: a secondary transfer belt 82, as a recording medium conveying member, which also is an endless belt; and a secondary transfer roller 82, which is disposed on the inward side (back surface side) of the loop which the belt 82 forms, as will be described later in detail. The secondary transfer roller 82 is kept pressed toward the belt-backing roller 73, with the presence of the intermediary transfer belt 7 and secondary transfer belt 81 between itself and the belt-backing roller 73, forming thereby the secondary transferring portion N2 (secondary transfer nip), which is the area of contact between the intermediary transfer belt 7 and secondary transfer belt 81. Further, on the outward side (outward surface side) of the loop which the intermediary transfer belt 7 forms, an intermediary transfer belt cleaner 74 is disposed as an intermediary transferring member cleaning means, in such a manner that it opposes the driver roller 72.

As described above, the toner image formed on the photosensitive drum 1 is electrostatically transferred (primary transfer) onto the rotating intermediary transfer belt 7 by the function of the primary transfer roller 5, in the primary transferring portion N1. During this process, the primary transfer bias (primary transfer voltage), the polarity of which is opposite (positive in this embodiment) from the normal polarity of toner charge, is applied to the primary transfer roller 5, whereby primary transfer current is supplied to the primary transferring portion N1. For example, in an image forming operation in which a full-color image is formed, four toner images which are formed on the photosensitive drums 1Y, 1M, 1C and 1Bk, one for one, and are different in color, are transferred onto the intermediary transfer belt 7, in the primary transferring portion N1, in such a manner that they are sequentially layered on the intermediary transfer belt 7. Consequently, four monochromatic toner images, which are different in color, are layered as the precursor of the full-color image to be formed on a sheet P of recording medium. Unwanted adherents, such as the toner (primary transfer residual toner) remaining on the photosensitive drum 1 after the primary transfer process, are removed and recovered by a drum cleaner 6.

The toner image formed on the intermediary transfer belt 7 is sent to the secondary transferring portion N2 by the rotation of the intermediary transfer belt 7. Meanwhile, sheets P of recording medium (recording medium, transferring member), such as sheets of paper, stored in a recording medium cassette (unshown) are fed one by one into the main assembly of the image forming apparatus 100 by a sheet feeding-conveying roller (unshown). Then, each sheet P of recording medium is conveyed to the secondary transferring portion N2 by a pair of registration rollers 12, which delivers the sheet P of recording medium to the secondary transferring portion N2, in synchronism with the timing with which the toner image on the intermediary transfer belt 7 is delivered to the secondary transferring portion N2. On the upstream side of the secondary transferring portion N2 in terms of the direction in which the sheet P is conveyed, a guide 13*a* and a guide 13*b* are disposed as recording medium conveyance guides which regulate the sheet P as the sheet P is conveyed to the secondary transferring portion N2. More concretely, the guiding member 13*a* regulates a sheet P of recording medium in behavior as the sheet P approaches the surface of the intermediary transfer belt 7. It is disposed on the outward side of the intermediary transfer belt 7. Further, it is disposed on the upstream side of the secondary transferring portion N2. The guiding member 13*b* regulates the sheet P in behavior as the sheet P separates from the outward surface of the intermediary transfer belt 7. It also is disposed on the outward side of the intermediary transfer belt 7. It is between the two guiding members 13*a* and 13*b* that the sheet P passes. That is, as the sheet P is conveyed from the pair of registration rollers 12 to the secondary transferring portion N2, its path is regulated by the two guiding members 13*a* and 13*b*.

The toner image on the intermediary transfer belt 7 is electrostatically transferred (secondary transfer) onto a sheet P of recording medium by the function of the secondary transferring device 8, in the secondary transferring portion N2, while the sheet P is conveyed through the secondary transferring portion N2, remaining pinched between the intermediary transfer belt 7 and secondary transfer belt 81. During this process, the secondary transfer bias (secondary transfer voltage), the polarity of which is opposite (positive in this embodiment) from the normal polarity of the toner charge, is applied to the secondary transfer roller 82. Thus, the secondary transfer current is supplied to the secondary transferring portion N2. The unwanted adherents, such as the toner (secondary transfer residual toner), remaining on the intermediary transfer belt 7 after the secondary transfer process, are removed from the intermediary transfer belt 7, and are recovered, by intermediary transfer belt cleaner 74.

After the transfer of the toner image onto a sheet P of recording medium, the sheet P is separated from the intermediary transfer belt 7 and secondary transfer belt 81, and then, is conveyed to the fixing device 16. In this embodiment, the image forming apparatus 100 is provided with a separation pawl 14 for preventing the sheet P from electrostatically wrapping around the secondary transfer belt 81 after the sheet P is separated from the secondary transfer belt 81. The image forming apparatus 100 is also provided with a pre-fixation sheet conveying device 15, which is disposed on the downstream side of the separation pawl 14 to convey the sheet P to the fixing device 16. The unfixed toner image on the sheet P is fixed to the sheet P by the fixing device 16, and then, the sheet P is discharged (outputted) from the main assembly of the image forming apparatus 100.

In this embodiment, by the way, the image forming portions SY, SM, SC and SBk make up a toner image forming means which is capable of forming a toner image on the intermediary transfer belt 7 with the use of multiple toners which are different in color.

Further, the image forming apparatus 100 has also a color sensor 17, as a detecting means, which detects the information related to the color of the image on a sheet P of recording medium, that is, the image fixed to the sheet P by the fixing device 16. The color sensor 17 is used to detect the information related to a test image on a sheet P of recording medium, when the image forming apparatus 100 is operated in the adjustment mode as necessary, as will be described later in detail.

2. Secondary Transferring Device

Next, the second transferring device 8 in this embodiment is described in greater detail. The second transferring device 8 is an example of transferring means for transferring the toner image formed on the image bearing member, onto a sheet P of recording medium, in the secondary transferring portion N2. It has the secondary transfer belt 81, which is an endless belt, which is suspended and kept tensioned by multiple belt suspending-tensioning rollers (supporting members), which are the secondary transfer roller 82, a tension roller 84, and a driver roller 85. The secondary transfer roller 82 forms the secondary transferring portion N2 by sandwiching the intermediary transfer belt 7 and secondary transfer belt 81 between itself and the belt-backing roller 73. The separation roller 83 separates a sheet P of recording medium after the sheet P moved through the secondary transferring portion N2. The tension roller 84 provides the secondary transfer belt 81 with tension by being kept pressed upward (toward the outward side) of the secondary transfer belt 81 from the inward side of the secondary transfer belt 81 by springs (unshown) as pressure applying means. The driver roller 85 moves (rotates) the secondary transfer belt 81 by transmitting the driving force from a belt driving motor (unshown) as a driving means, to the secondary transfer belt 81. The secondary transfer belt 81 is rotationally driven by the driver roller 85 in the direction indicated by an arrow mark R3 in FIG. 1.

In this embodiment, the secondary transfer roller 82 comprises a metallic core (core member), and an elastic layer formed on the peripheral surface of the metallic core, of ion-conductive formed rubber (NR rubber). It is 24 mm in external diameter, 6.0-12.0 (μm) in the surface roughness Rz of its surface layer, and $1\times10^5$-$1\times10^7\Omega$ in electrical resistance (measured in N/N (23° C., 50% in RH) with application of 2 kV). The hardness of the elastic layer is roughly 30-40 (in Asker-C hardness scale). Further, the secondary transfer roller 82 is in connection to a secondary transfer bias power source 87 (high voltage power source), which can be changed in output bias and is enabled to apply the secondary transfer bias to the secondary transfer roller 82. As the secondary transfer bias is applied to the secondary transfer roller 82, not only is the toner image on the intermediary transfer belt 7 transferred onto a sheet P of recording medium supplied to the secondary transferring portion N2, but also, the sheet P is electrostatically adhered to the secondary transfer belt 81. The secondary transfer bias power source 87 is an example of applying means for applying the transfer bias (secondary transfer bias) for transferring the toner image on the secondary transfer belt 81, onto the sheet P while the sheet P is conveyed through the transferring portion (secondary transferring portion). In this embodiment, the secondary transfer bias is applied to the secondary transfer roller 82 so that +40-60 μA of electric current flows.

The secondary transfer belt 81, which is supported by the secondary transfer roller 82 in such a manner that it partially covers the peripheral surface of the secondary transfer roller 82 in terms of the rotational direction of the roller 82, conveys downstream, the sheet P of recording medium adhered to the outward surface of the secondary transfer belt 81, in the secondary transferring portion N2, by being moved in the direction indicated by the arrow mark R3. As the sheet P of recording medium on the secondary transfer belt 81 reaches the separation roller 83 disposed in the downstream adjacencies of the secondary transfer roller 82 in terms of the rotational direction of the secondary transfer belt 81, it is separated from the surface of the secondary transfer belt 81 by the curvature of the separation roller 83. After the sheet P is separated from the secondary transfer belt 81, it is conveyed to the fixing device 16 as described previously.

By the way, as the material for the secondary transfer belt 81, a compound created by dispersing a proper amount of carbon black, as charge inhibition agent, in such resin as polyimide and polycarbonate, is preferable. The secondary transfer belt 81 is desired to be roughly $1\times10^9$-$1\times10^{14}$ Ω·cm in volume resistivity, and 0.07-0.10 mm in thickness. Further, the secondary transfer belt 81 may be no less than 100 MPa, and no more than 10 GPa, in Young's modulus, measured with the use of a tensile test (JIS K 6301). That is, it may be rather hard.

3. Secondary Transfer Bias

As described above, a phenomenon referred to as "transfer blemish" sometimes occurs to the leading and trailing edge portions of a sheet P of recording medium. The "transfer blemish" is likely to occur as the intermediary transfer belt 7 is made to vibrate when the leading edge portion of the sheet P enters the secondary transferring portion N2, or the trailing edge portion of the sheet P leaves the guiding members 13*a* and 13*b*. Further, the "transfer blemish" can be prevented by reducing the secondary transfer bias as described above. In this embodiment, therefore, the occurrence of the "transfer blemish" is prevented by controlling the secondary transfer bias in synchronism with the timing with which the sheet P enters the secondary transferring portion N2. Here, the secondary transfer bias which is necessary for the secondary transfer has to be adjusted in strength according to recording medium type. Further, whether or not the "transfer blemish" occurs, and the severity of the "transfer blemish", are affected by the recording medium type. Therefore, it is desired that the secondary transfer bias is set according to recording medium type.

By the way, typically, recording media are classified (differentiated) based on their basis weight, surface properties, size, material, etc. That is, they are classified according to their properties which affect the transfer bias to be set therefor. Further, even if recording media are practically the same in the abovementioned properties, they may differ based on their makers, and histories such as date of manufacture, and the length of time in storage. That is, recording medium type is such a property of recording medium that can be used to differentiate the recording media by an operator such an ordinary user or a service personnel, when he or she registers the recording media. In other words, that the recording media are different in type does not necessarily mean that they are different in the abovementioned properties and history.

Figure 12:
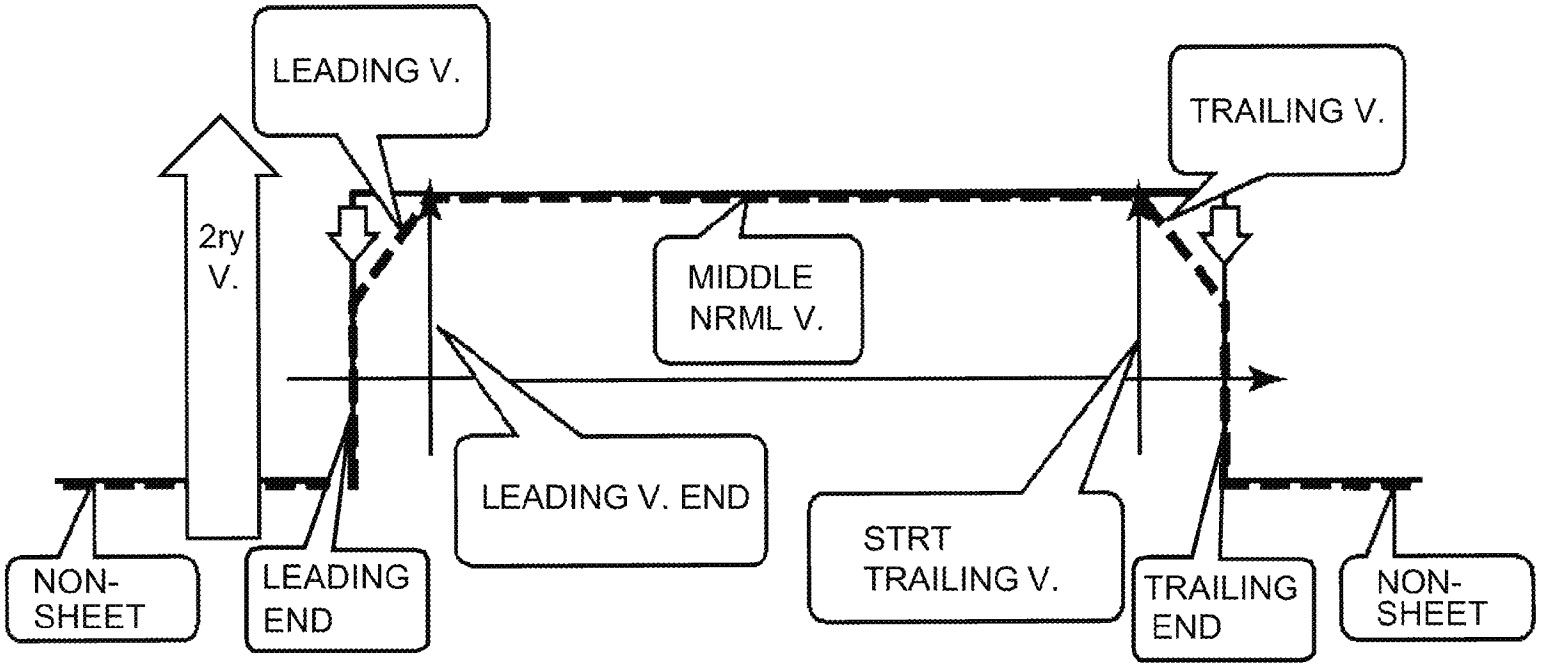
FIG. 12 is a drawing for describing the conditions to be set for the secondary transfer bias.

The typical conditions which are to be set according to the type of recording medium are the following five (FIG. 12).

Value for leading edge portion bias

Point (timing) at which the application of leading edge portion bias is to be ended Value for center portion bias Point (timing) at which the application of the trailing edge portion bias is to be started Value for trailing edge portion bias.

Thus, the image forming apparatus 100 in this embodiment is provided with a controlling means which controls each of the leading edge portion bias which is the transfer bias to be applied to the leading edge portion of a sheet P of recording medium, the trailing edge portion bias which is the transfer bias to be applied to the trailing edge portion of the sheet P, and the center portion bias which is the transfer bias to be applied to the center portion of the sheet P. By the way, the "center portion of the sheet P" means the portion of the sheet P, which is between the leading and trailing portions of the sheet P. The leading edge portion of the sheet P has only to be the portion of the sheet P, which is on the leading edge side of the center portion. It does not need to include the leading edge. Similarly, the trailing edge portion of the sheet P has only to be the portion of the sheet P, which is on the trailing edge side of the center portion of the sheet P. It does not need to include the trailing edge. The image forming apparatus 100 has a setting means for setting the conditions for the leading edge portion bias, center portion bias, and trailing edge portion bias, in relation to recording medium type. The setting means forms a test image on each of the leading edge portion, center portion, and trailing edge portion of a sheet P of recording medium, and sets the bias conditions for each of the abovementioned three portions, based on the information related to the color of the test image, which is detected by the detecting means 17. In this embodiment, a printer controller 300, which will be described later, has the function of the abovementioned controlling means, and also, the function of the setting means. Typically, the conditions for the leading edge portion bias include the position (application timing), in terms of the direction in which the sheet P is conveyed, for applying the leading edge portion bias, and the strength (value) for the leading edge portion bias. Further, the conditions for the trailing edge portion bias include the position, in terms of the direction in which the sheet P is conveyed, for the application of the leading edge portion bias, and the strength of the trailing edge portion bias. Further, typically, the conditions for the center portion bias include the strength of the center portion bias.

In particular, in this embodiment, the image forming apparatus 100 is enabled to operate in the adjustment mode (recording medium registration mode) in which it sets the above-mentioned five conditions for the secondary transfer bias for each of various types of recording medium. In the adjustment mode, the image forming apparatus 100 forms a preset test image on a sheet P of recording medium to be used for image formation, that is, the sheet P for which the conditions for the secondary transfer bias are to be set, and detects the information related to the color of the test image, with the use of the color sensor 17. The general description of the adjustment mode in this embodiment is as follows:

First, a test image (which may be referred to as "center portion test image") is formed on the center portion of a sheet P of recording medium by transferring a toner image formed of at least two toners, which are different in color, onto the sheet P, and fixing the toner image to the sheet P through a fixing process (melt toners to cause toners to mix in order to yield desired color). In this embodiment, multiple center portion test images are formed (transferred) on the center portion of a single sheet P of recording medium, with the use of multiple secondary transfer biases, which are different in value. Then, the information related to the color of the center portion test images is detected by the color sensor 17. Then, the image forming apparatus 100 sets the value for the center portion bias, based on the relation between the information related to the detected colors and the value for the secondary transfer bias. To describe in greater detail, the image forming apparatus 100 obtains a value for the secondary transfer bias, which can minimize the color deviation of the center portion test images, and sets this value as the value for the center portion bias.

Further, the image forming apparatus 100 forms a test image (which may be referred to as "first leading edge portion test image") on the leading edge portion of a sheet P of recording medium, by transferring a toner image formed of a single toner, and fixing the toner image to the sheet P through the fixation process. Then, it detects the information related to this first leading edge portion test image, with the use of the color sensor 17, determines the position (area) where the blemishes (white flowers) attributable to electrical discharge occurred, and choose this point as the point at which the application of the leading edge portion bias is to be ended. Similarly, the image forming apparatus 100 forms a test image (which may be referred to as "first trailing edge portion test image") on the trailing edge portion of the sheet P by transferring a toner image formed of a single toner, and fixing the toner image to the sheet P through the fixation process. Then, it detects the information related to the color of this trailing edge portion test image, with the use of the color sensor 17, determines the point (area) where the blemishes (white flowers) occurred, and chooses this point as the point at which the application of the trailing edge portion bias is to be started.

Further, the image forming apparatus 100 forms a test image (which may be referred to as "second leading edge portion test image") on the leading edge portion of a sheet P of recording medium, by transferring a monochromatic toner image, which is different from the abovementioned one, onto the sheet P, and fixing the toner image to the sheet P through the fixation process. The image forming apparatus 100 forms the second leading edge portion test image on the leading edge portion of each of multiple sheets P, with the use of secondary transfer biases which are different in value, one for one. Then, it detects the information related to the color of the second leading edge portion test image with the use of the color sensor 17. Then, it sets the value for the leading edge portion bias, based on the relationship between the detected information related to the color and the value for the transfer bias. Similarly, the image forming apparatus 100 forms a test image (which may be referred to as "second trailing edge portion test image") on the trailing edge portion of the sheet P by transferring a toner image formed of monochromatic toner which is different from the abovementioned one, onto the sheet P, and fixing the toner image to the sheet P through the fixation process. This second trailing edge portion test image is formed on each of multiple sheets P, with the use of secondary transfer biases, one for one, which are different in values. Then, it detects the information related to the color of the trailing edge portion test image with the use of the color sensor 17, and sets the value for the trailing edge portion bias, based on the relationship between the information related to the detected color, and the value for the secondary transfer bias.

In particular, in this embodiment, a test chart 1 which includes the abovementioned center portion test image, first leading edge portion test image, and first trailing edge portion test image is formed on a single sheet P of recording medium. Further, a test chart 2 which includes the abovementioned second leading edge portion test image, and the second trailing edge portion test image, is formed on each of the multiple sheets P, with the use of multiple transfer biases, one for one, which are different in value. In this embodiment, for the test chart 1, the image forming apparatus 100 forms the first leading edge portion test image and first trailing edge portion test image, with the use of the secondary transfer bias having such a value (maximum value, for example, in adjustment range) that is likely to cause "transfer blemish". Further, the first leading edge portion test image and first trailing edge portion test image are formed as images which are relatively small in the amount of toner and are likely to cause the "transfer blemish." Typically, they are formed as monochromatic halftone images. Then, the image forming apparatus 100 determines the point where the "transfer blemish" is likely to occur, based on the changes in luminosity detected by the color sensor 17, across the first leading edge portion test image and first trailing edge portion test image. Then, it chooses this point as the point at which the application of the leading edge portion bias is to be ended, and the point at which the application of the trailing edge portion bias is to be started, respectively. Further, in this embodiment, the image forming apparatus 100 forms multiple center portion test images, which are different in the value of the secondary transfer bias, on each test chart 1. In order to ensure that transfer bias can be set so that even a high density image can be fully transferred, the center portion test image is formed as an image which is relatively large in the amount of toner. Typically, the center portion test image is formed as a high order color (such as secondary color) solid image, with the use of multiple toners, for example, two toners, which are different in color. Then, the image forming apparatus 100 sets a value for the central portion, which is necessary and sufficient for satisfactory transfer. Further, in this embodiment, the image forming apparatus 100 forms the test chart 2 which includes the second leading edge portion test image and second trailing edge portion test image, with the use of secondary transfer biases, one for one, which are different in value. The second leading edge portion test image and second trailing edge portion test image are formed as images which are relatively small in the amount of toner and are likely to cause the "transfer blemish". Typically, they are monochromatic halftone images. Then, the image forming apparatus 100 sets a value for the leading edge portion bias, and a value for the trailing edge portion bias, which are unlikely to cause the "transfer blemish", based on the changes in luminosity detected by the color sensor 17 across the second leading edge portion test image and second trailing edge portion test image, which are attributable to the secondary transfer bias.

By operating the image forming apparatus 100 in the adjustment mode such as the above-described one, it is possible to automatically optimize the apparatus 100 in the abovementioned five conditions for the secondary transfer bias, for each type of recording medium. Therefore, even an operator who has not received special training for the apparatus 100 can easily set the optimal conditions for the secondary transfer bias. That is, this embodiment can improve an image forming apparatus such as the one described above, in image quality and operability. Moreover, the present invention is beneficial even for an experienced operator. That is, it took roughly 30 minutes for an experienced operator to properly set a conventional image forming apparatus. In comparison, it may take only three minutes or so to properly set the image forming apparatus 100 in this embodiment. In other words, this embodiment (present invention) can substantially reduce the length of time it takes to properly set up an electrophotographic image forming apparatus.

4. Control Panel

Figure 2:
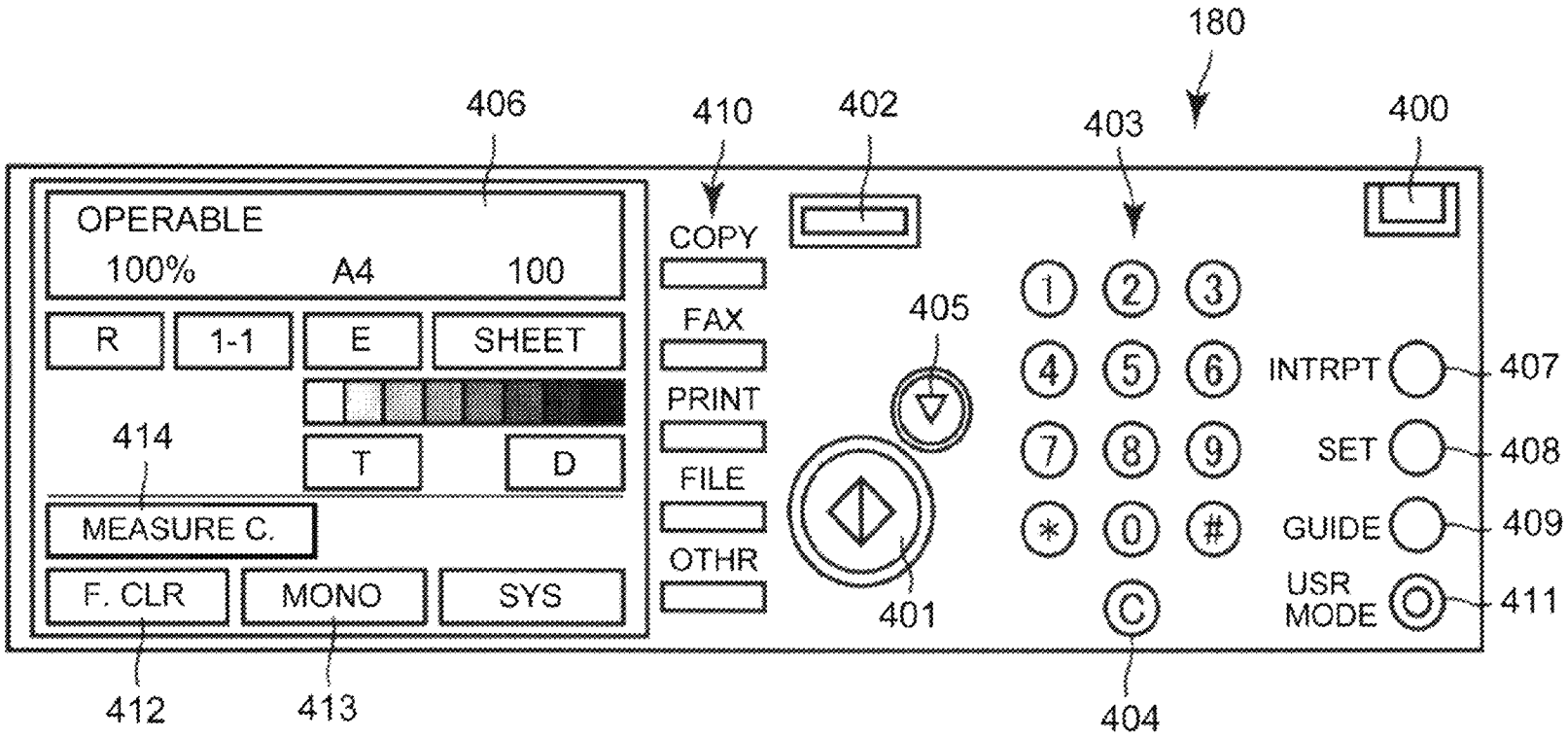
FIG. 2 is a schematic drawing of the control panel of the image forming apparatus.

FIG. 2 is a plan view of the control panel 180, as a controlling portion, with which the image forming apparatus 100 is provided. The control panel 180 is provided with a soft switch 400 for turning on or off the electrical power source of the main assembly of the image forming apparatus 100. It is provided with also a copy start key 401 for an operator to instruct the image forming apparatus 100 to start a copying operation. Further, it is provided with a reset key 402 for restoring the standard mode, which is a one-sided full-color mode, for example. Further, it is provided with a ten-key pad 403 for inputting a numerical value such as copy count. Further, it is provided with a clear key 404 for clearing a numerical value. Further, it is provided with a stop key 405 for stopping an ongoing continuous copying operation. Further, it is provided with a liquid display/touch panel 406 for putting the image forming apparatus 100 in one of various operational modes, and displaying the condition of the image forming apparatus 100. Further, it is provided with an interruption key 407 for temporarily interrupting the ongoing copying, faxing, or printing operation to obtain an urgently needed copy, for example. Further, it is provided with a memory key 408 for individually controlling copy count for each person or each department. Further, it is provided with a guidance key 409 which is to be pressed down when it is necessary to use a guidance function. Further, it is provided with a function key 410 which is to be used for changing the image forming apparatus 100 in function. Further, it is provided with a user mode key 411 which is to be used by a user to control the image forming apparatus 100. For example, the user mode key 411 is used to put the image forming apparatus 100 in the user mode, which is for calibrating the sensor in sensitivity, adjust the apparatus 100 in density and color tone, register recording medium type (selection), change the image forming apparatus 100 in the length of time to be allowed to elapse before the image forming apparatus 100 is to be put in the economy mode, or the like action. In this embodiment, as an operator presses the user mode key 411, a user menu appears on the liquid crystal display/touch panel which is usable to put the image forming apparatus 100 in the user mode, in which an operator can select the recording medium type registration mode, for example. Further, the control panel 180 is provided with a color measurement mode key 414, a full-color mode key 412, and a monochromatic mode key 413.

5. Image Processing Portion

Figure 3:
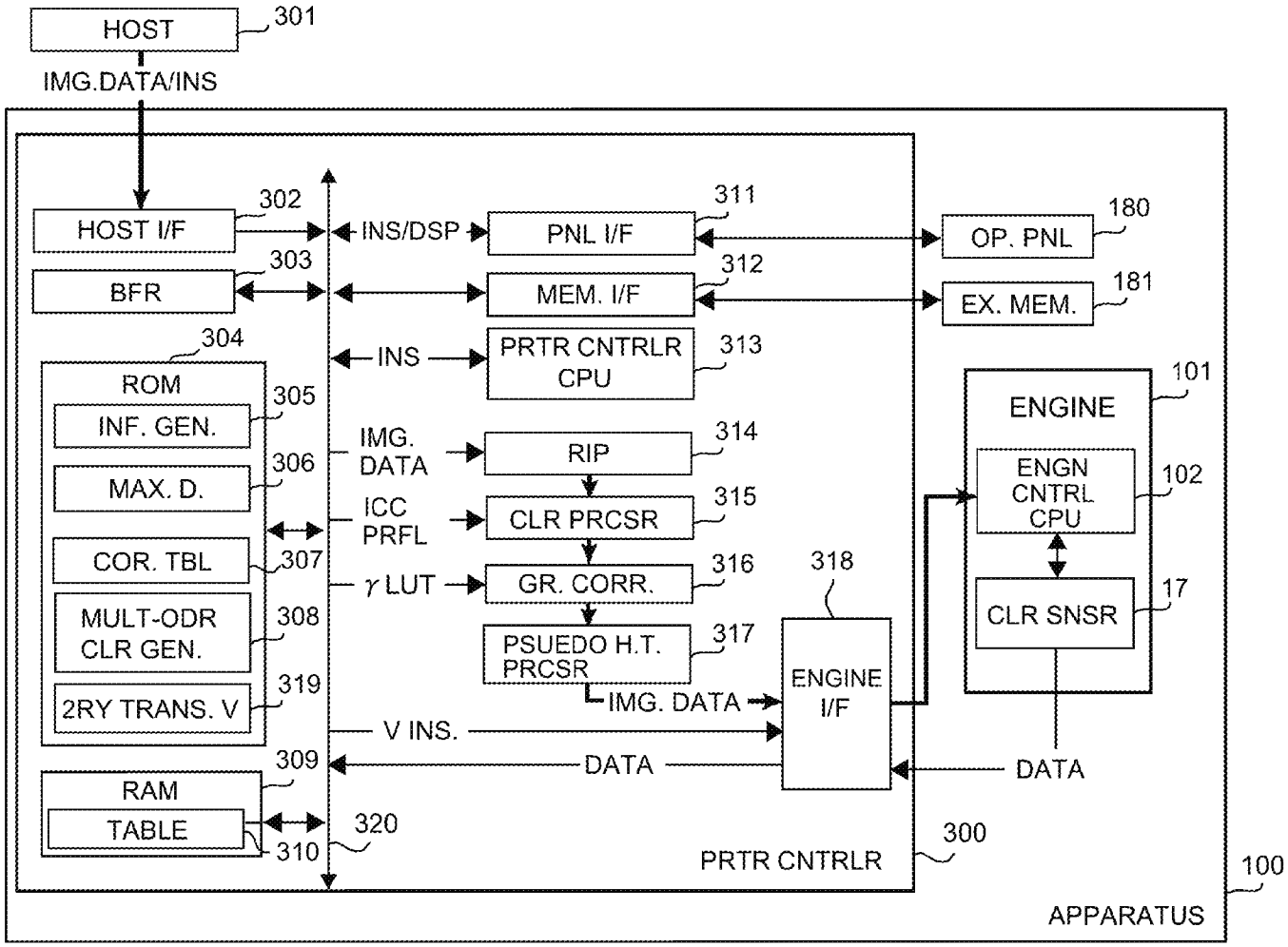
FIG. 3 is a block diagram of the image forming apparatus, which shows the structure of the apparatus.

FIG. 3 is a block diagram of the image forming apparatus 100 in this embodiment. It shows the structure of the image formation system. The image forming apparatus 100 is connectible to a host computer 301 so that communication is possible between the apparatus 100 and computer 301. For example, the host computer 301 and image forming apparatus 100 are connectible to each other with the use of a communication line such as USB 2.0 High-Speed, 1000 Base-T/100 Base-TX/10 Base-T (IEEE 802.3 compatibility).

The printer controller 300 controls the overall operation of the image forming apparatus 100. It has: a host I/F portion 302 which controls the input from the host computer 301 and the output to the host computer 301; and an input/output buffer 303 through which the control codes from the host I/F portion 302, and the data from various communicating means, are transmitted. Further, the printer controller 300 has: a printer controller CPU 313 which controls the overall operation of the printer controller 300; and a program ROM 304 in which the control programs and control data for the printer controller CPU 313 are stored. Further, it has a ROM 309 (storing means) which is used as a work memory for the computation necessary for the interpretation and printing of the abovementioned control codes and data, or processing the print data. Further, the printer controller 300 has an image information generating portion 305 which generates various image objects, based on the data settings received from the host computer 301. Further, it has a RIP (Raster Image Processor) portion 314 which develops the image object into a bit map image. Further, it has: a color processing portion 315 which carries out the high order color conversion process, which will be described later; a toner adjustment portion guiding device 316 which carries out monochromatic tone adjustment process; a pseudo halftone processing portion 317 which carries out a pseudo halftoning process, such as dither matrix and error dispersion method. Further, it has an engine I/F portion 318 which transfers the converted image information to an image formation engine portion 101. The image formation engine portion 101 forms an image, following the transferred image information. The foregoing is the basic flow of the image processing sequence by the printer controller 300, which occurs during an image forming operation. It is indicated by solid bold lines in FIG. 3.

The printer controller 300 controls not only the above-described image forming process, but also various control computations, the control programs which are stored in the program ROM 304. That is, the printer controller 300 has a maximum density condition deciding portion 306 (Vcont: referred to as development contrast) which carries out density adjustment. It has also a toner adjustment table generating portion (γ LUD) which carries out density tone adjustment, based on the result of the maximum density adjustment. Further, it has a multidimensional table generating portion 308 (ICC profile) which generates ICC profile which is a multidimensional LUT. Further, it has a secondary transfer bias condition deciding portion 319 (setting portion) for deciding the secondary transfer bias condition for the adjustment mode as will be described later.

Further, the printer controller 300 has a storing portion 310 which temporarily stores the adjustment results of the above-described maximum density condition deciding portion 306, toner adjustment table generating portion 307, and high order color table generating portion 308. Further, it has a panel I/F portion 311 which connects the control panel 180 for operating the image forming apparatus 100, instructing the image forming apparatus 100 to carry out the adjustment mode, which will be described later, or the like, to the printer controller 300, and an external memory portion 181 used for storing the print data, various data about the image forming apparatus 100, and the like, via memory interface 312. Further, the printer controller 300 has a system bus 320 which connects various units.

The image information generating portion 305, maximum density condition deciding portion 306, tone adjustment table generating portion 307, high order color table generating portion 308 which reflects the results of the high order color adjustment, and secondary transfer bias condition deciding portion 310 are stored as modules in the program ROM 304.

Through various system buses, it is possible to output toner images having a desired color by controlling and renewing the ICC profile, γLUT, Vcont, second transfer bias, which are used for image formation, and make the color processing portion 315, tone adjusting portion guiding device 316, and the like, reflect the results of the high order color adjustment.

By the way, in the adjustment mode for deciding the conditions for the secondary transfer bias, which will be described later in detail, the information related to the measurement data from the color sensor 17 is sent to a decision making portion 319, is judged, and the results of the judgment are sent to the printer controller CPU 313. The printer controller CPU 313 stores the information related to the recording medium type (media information), and the information related to the decided conditions for the secondary transfer bias, and their relationship, in the table storing portion 310.

As the image forming apparatus 100 is given a command to carry out the normal printing operation, the printer controller CPU 313 refers to the information related to the recording medium type registered in the table storing portion 310. If the type of the sheet P of recording medium selected to be used for a printing operation is registered in the table storing portion 310, the printer controller CPU 313 reads the information (optimum adjustment value for second transfer bias) related to the secondary transfer bias condition which corresponds to the type of the sheet P of recording medium to be used for the image formation. Then, it sends the results to the image formation engine portion 101 through the engine I/F portion 318. The printer engine portion 101 prints images under the above-described conditions for the second transfer bias, following the commands from the engine control CPU 102.

6. Color Sensor

Figure 4:
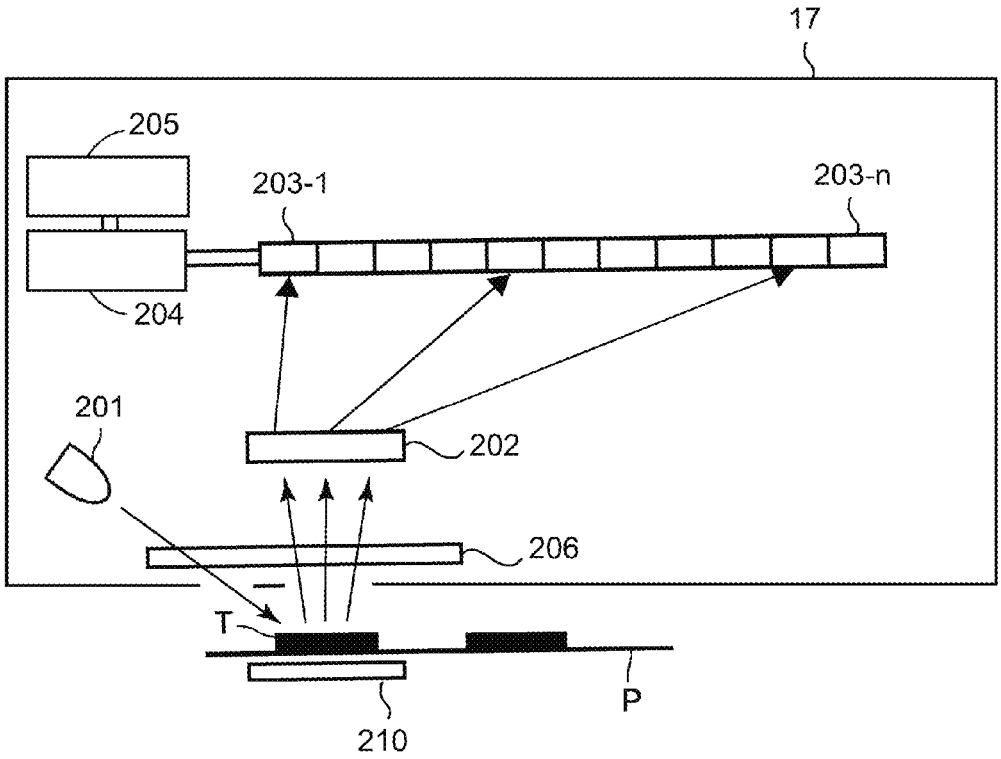
FIG. 4 is a schematic drawing of the color sensor of the image forming apparatus.

FIG. 4 is a schematic drawing of the color sensor 17 (spectral sensor). It shows the structure of the color sensor 17. The color sensor 17 has a white color LED 201 which sheds light on a test image T (test pattern, patch) fixed to the surface of a sheet P of recording medium. It has also a diffraction grating 202 which separates the light reflected by the test image T, into color components which are different in wavelength. Further, it has a line sensor 203 (203-1-**203-*n*) which detects the color components, different in wavelength, into which the light reflected by the test image T was separated. The line sensor 203 is made up of multiple (n) elements. Further, it has a computing portion 204 which carries out various computations from the light intensity value of each pixel detected by the line sensor 203, and a memory 205 which stores various data. The computing portion 204 has a spectrally computing portion which carries out spectral computation based on the light strength value; a Lab computing portion which computes the Lab value, etc. Further, the color sensor 17 internally stores a lens 206 which makes the light emitted from the white light LED 201, converge onto the test image on the sheet P, and also, focus the light reflected by the test image upon on the spectral grating 202. In this embodiment, such a lens that is immune to the fluttering of the sheet P is used as the lens 206**.

In this embodiment, the image forming apparatus 100 is provided with four color sensors 17, which are aligned in the direction parallel to the primary scan direction. The four color sensors 17 can be independently used to detect the corresponding test images which are different in their position on the test charts which will be described later. By the way, the information about the test images may obtained by detecting a single test image T with the use of some of the four color sensors 17, and averaging the results of detection.

By the way, "primary scan direction" is such a direction (parallel to rotational axis of photosensitive drum 1) that is roughly perpendicular to the direction in which a sheet P of recording medium is conveyed, whereas the "secondary scan direction" is such a direction (direction in which sheet P is conveyed) that is roughly perpendicular to the primary scan direction.

7. Color Measurement (L*a*b* Computation)

In this embodiment, the computing portion 204 of the color sensor 17 has a Lab computing portion. It calculates a CIE (International Commission On Illumination) value of coordinate of each of L*, a*, b* in L*a*b* color space, in order to decide the conditions for the secondary transfer bias. The following are the contents of the computation for calculating the chromaticity value (information about L*a*b* chromaticity (Regulation ISO13655).

a. Obtain spectral reflectivity R(λ) of test image (380 nm-780 nm)

b. Prepare color matching functions x(λ), y(λ), and z(λ), and standard light spectral distribution SD 50 (λ).

By the way, color matching functions are defined in JIS Z8701, and SD50 (λ) is defined in JIS Z8720, being sometimes referred to as auxiliary standard illuminant D50.

c. R(λ)×SD50 (λ)×x(λ), R(λ)×SD50 (λ)×y(λ), R(λ)×SD50(λ)×z(λ)

d. Integrate each wavelength range Σ{R(λ)×SD50 (λ)×x(λ)}, Σ{R(λ)×SD50 (λ)×y(λ)}, Σ{R(λ)×SD50(λ)×z(λ)} e. Integrate product of color matching function y(λ) and standard light spectral distribution SD50 (λ), for each wavelength range $$\Sigma\{SD50(\lambda)\times y(\lambda)\}$$

f. Calculate XYZ $$X=100\times\Sigma\{SD50(\lambda)\times y(\lambda)\}/\Sigma\{R(\lambda)\times SD50\times x(\lambda)\}$$

$$Y=100\times\Sigma\{SD50(\lambda)\times y(\lambda)\}/\Sigma\{R(\lambda)\times SD50\times y(\lambda)\}$$

$$Z=100\times\Sigma\{SD50(\lambda)\times y(\lambda)\}/\Sigma\{R(\lambda)\times SD50(\lambda)\times z(\lambda)\}$$

g. Calculate L*a*b*

$$L^*=116\times(Y/Yn)\hat{}(1/3)-16$$

$$a^*=500\{(X/Xn)\hat{}(1/3)-(Y/Yn)\hat{}(1/3)\}$$

$b^*=200\{(Y/Yn)\hat{}(1/3)-(Z/Zn)\hat{}(1/3)\}$ (however, $Y/Yn>0.008856$, and $Xn, Yn, Zn$ are standard light stimulus values).

Further, if $Y/Yn\leq 0.008856$, the left sides of the equations given above are to be replaced by the right sides of the equations given below:

$$(X/Xn)\hat{}(1/3)=7.78(X/Xn)\hat{}(1/3)+16/116$$

$$(Y/Yn)\hat{}(1/3)=7.78(Y/Yn)\hat{}(1/3)+16/116$$

$$(Z/Zn)\hat{}(1/3)=7.78(Z/Zn)\hat{}(1/3)+16/116.$$

It is possible to obtain L*a*b* (* may be sometimes omitted) from the spectral reflectivity, with the use of the equations given above.

It is possible to obtain L*a*b* (* may be sometimes omitted) from the spectral reflectivity, with the use of the equations given above.

Further, when the second transfer bias conditions are decided, the difference in color between a patch and a sheet P of recording medium is used, although it depends on color. "Difference in color" is the distance between two points in the three dimensional Lab space. It can be calculated with the use of the following equation. By the way, in this embodiment, it is assumed that paper is used as recording medium. Thus, recording medium may be sometimes referred to simply as "paper."

Difference in color between paper and patch=(paper $L$−patch $L$)^2+(paper $a$−patch $a$)^2+(paper $b$−patch $b$)^2))^0.2.

By the way, in order to adjust the color sensor 17, a combination of a white referential plate 210 and a white color LED is used, or the results of detection by the color sensor 17 are converted into standard spectral resistivity. As the means for adjusting the color sensor 17, any of known methods can be used. Therefore, it is not described further.

8. Test Chart 1

Figure 5:
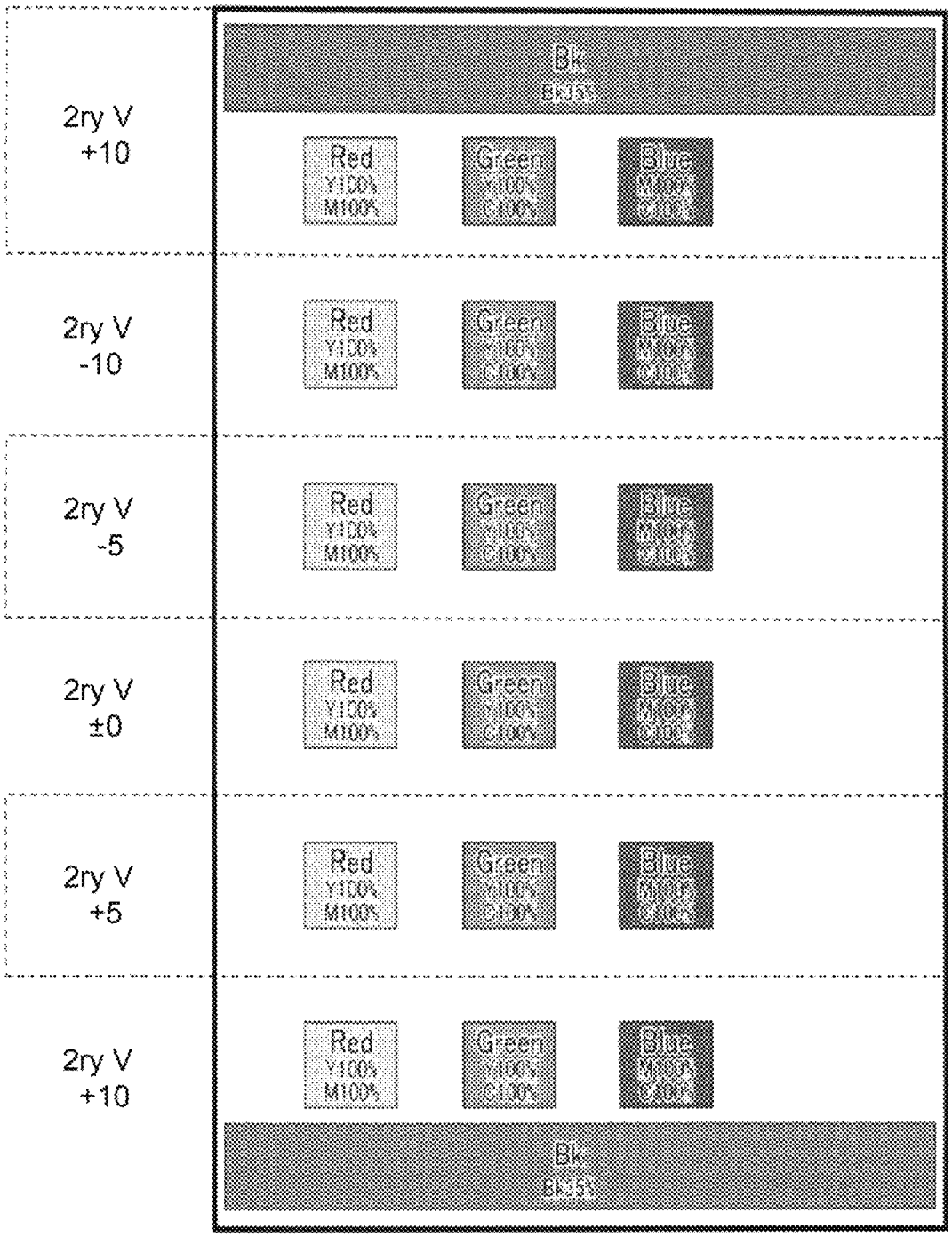
FIG. 5 is a schematic drawing of the test chart 1.

FIG. 5 is the test chart 1 in this embodiment. By the way, here, yellow, magenta, cyan, black, red, green and blue colors may be sometimes abbreviated as Y, M, C, Bk, R, G and B, respectively. Here, the density of each of the toner images different in color may be added, with the signal value (density level) of a solid image being set to 100%.

Referring to FIG. 5, the area surrounded by a solid black line corresponds to the size of a sheet P of recording medium. Also referring to FIG. 5, the top side corresponds to the leading edge side of the sheet P in terms of the paper conveyance direction. In this embodiment, the first leading edge portion test image and first trailing edge portion test image, which are black in color and are in the form of a long and narrow rectangle, are formed in relatively light halftone (35%) on the leading and trailing edge portions, respectively, of a sheet P of recording medium. More specifically, the first leading edge portion test image is formed no more than 3 cm away from the leading edge of the sheet P (in terms of secondary scan direction). The first trailing edge portion test image is formed no more than 3 cm away from the trailing edge of the sheet P (in terms of secondary scan direction). However, the dimension of the areas of the sheet P, in terms of the secondary scan direction, across which the test images are formed one for one, may be changed as necessary according to the distance between the guiding member 13*a* and intermediary transfer belt 7, distance between guiding member 13*b* and intermediary transfer belt 7, the angle at which the sheet P comes into contact with the intermediary transfer belt 7, or the like factor. All that is necessary is that their dimension in terms of the secondary scan direction is no less than the dimension of the portions of the sheet P, across which transfer blemishes will possibly occur. Further, in this embodiment, the dimension of the first leading edge portion test image and first trailing edge portion test image, in terms of the primary scan direction, is roughly the same as that of the sheet P in terms of the same direction. However, this may be changed as necessary.

Further, in this embodiment, test images of the secondary colors (center portion test image), more specifically, Red (Y100%+M100%), Green (Y100%+C100%), and Blue (M100%+C100%), which are the same in signal value, are formed between the first leading edge portion test image and first trailing edge portion test image. In particular, in this embodiment, six center portion test images R, six center portion test images G, and six center portion test images B, are formed on a single sheet P of recording medium in such a pattern that in terms of the primary scan direction (left to right in FIG. 5), the images R, G and B align in the listed order, and also, so that in terms of the secondary scan, six images of the same color align.

The first leading edge portion test image and first trailing edge portion test image are transferred onto a sheet P of recording medium with the use of the maximum second transfer bias, the value of which is (+10) (adjustment value will be described later). That is, the first leading edge portion test image and first trailing edge portion test image are formed under such a condition that is high in the secondary transfer bias and is unfavorable to the "transfer blemish", in order to find the resistance of a sheet P of paper to be registered, that is, the sheet of paper selected as the recording medium for image formation. Although this sequence will be described later in detail, if the "transfer blemish" does not occur to the first leading edge portion test image and first trailing edge portion test image, the test chart 2, which will be described later, does not need to be formed. Further, the test chart 1 is formed so that in terms of the secondary scan direction, the second transfer bias adjustment values for the six center portion test images of the same color are +10, −10, −5, 0, +5 and +10. Then, the test chart 1 is transferred onto a sheet P of recording medium. By the way, the secondary transfer bias for the test images on the leading edge side, which has an adjustment value of +10, are continuously applied to transfer the first leading edge portion test image, and the first of the six central portion test images aligned in the secondary scan direction. The secondary transfer biases for the trailing edge side, which has an adjustment value of +10 are continuously applied to transfer the sixth of the central portion test images aligned in the secondary scan direction, and the first trailing edge portion test image.

Here, in this embodiment, an adjustment value of 0 corresponds to the value for the secondary transfer voltage (bias) for a referential sheet of paper, which is preset based on the basis weight, and surface properties (information such as whether or not recording paper is of high quality, is coated, etc.) of recording paper (medium). The value for the secondary transfer bias (which will be taken up by sheet of paper onto which image is transferred) is set in relation to the value of the secondary transfer bias for the referential sheet of paper, with the use of the following equations. By the way, the value for the portion of the secondary transfer bias (which will be taken up by sheet of paper to be outputted) is decided by adding (or subtracting) the voltages to be taken up by the secondary transferring member, etc., to (or from) the voltage to be taken up by the sheet of paper to be used for image formation, shared by paper. Here, attention will be paid to the portion of the second transfer voltage, which is to be taken up by the sheet of recording medium (paper), in order to make it easier to understand the present invention.

Voltage for sheet of paper to be outputted=(adjustment value)×voltage for referential paper×0.05+voltage for referential paper For example, the voltage for a sheet of paper on which an image is to be outputted when the voltage for the referential paper is 800 V is as follows:

Voltage for a sheet of paper when the adjustment value for the second transfer bias is −10=−10×800 V×0.05+800 V=400 V.

Voltage for a sheet of paper when the adjustment value for the second transfer bias is −5=−5×800 V×0.05+800 V=600 V.

Voltage for a sheet of paper when the adjustment value for the secondary transfer bias is −0=0×800 V×0.05+800 V=800 V.

Voltage for a sheet of paper when the adjustment value for the secondary transfer bias is +5=+5×800 V×0.05+800 V=1000 V.

Voltage for a sheet of paper when the adjustment value for the secondary transfer bias is +10=+10×800 V×0.05+800 V=1200 V.

9. Test Chart 2

Figure 6:
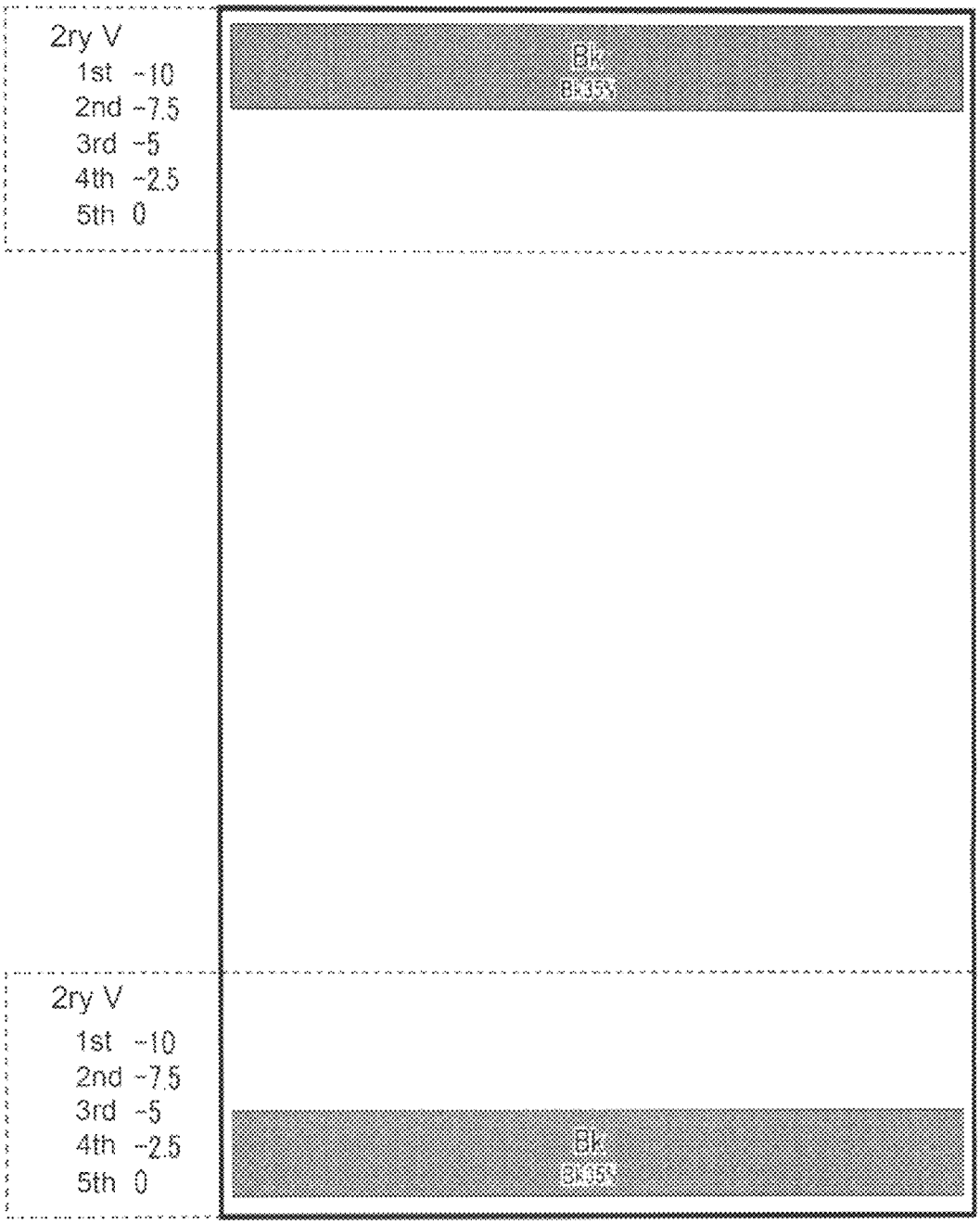
FIG. 6 is a schematic drawing of the test chart 2.

FIG. 6 shows the test chart 2 in this embodiment. The area surrounded by a bold solid black line corresponds to the size of a sheet P of paper. In this embodiment, the second trailing edge portion test image and second trailing edge portion test image are black in color and are in the form of a long and narrow rectangle. They are formed on the leading and trailing edge portions of the sheet P, respectively, in relatively light halftone (35% in density). That is, in the case of the test chart 2 in FIG. 6, only the leading and trailing edge portions of the sheet are provided with a test image. That is, the test chart 2 is the test chart 1 in FIG. 5 minus the center portion test images.

The value for the center portion bias is set with the use of the test chart 1, as will be described later. When the center portion of the test chart 2 is formed, a center portion bias having a preset value is applied to the center portion of a sheet P of recording paper, whereas when the leading and trailing edge portions of the test chart 2 are formed, such leading edge portion bias and trailing edge portion bias that their values are obtained by reducing the value for the secondary transfer bias, with the use of the following equations, are applied to the leading and trailing edge portions of the sheet P, respectively. In this embodiment, the above-described test chart 2 is formed on five sheets P of paper so that the five sheets P become different in the values for the leading edge portion bias and trailing edge portion bias. As for the value for the center portion bias for forming the five test charts 2, it is fixed to the value decided with the use of the test chart 1.

Voltage for the leading and trailing edge portions of a sheet of paper=(adjustment value)×voltage for the center portion of sheet×0.05+voltage for the center portion of sheet.

The five test charts 2 are formed with the use of five secondary transfer biases, one for one, which are different by an increment of 2.5 (absolute value) in adjustment value.

The adjustment values for the voltages for the leading and trailing edge portions of a sheet of paper:

First sheet: −10

Second sheet: −7.5

Third sheet: −5

Fourth sheet: −2.5

Fifth sheet: 0.

Points at which the application of the leading edge portion bias (weaker bias), and the application of the trailing edge portion bias (weaker), are to be ended are decided with the use of the test chart 1, as will be described later. Therefore, when the test chart 2 is formed, the leading edge portion bias and trailing edge portion bias are applied at the preset points (timings). Further, in this embodiment, from when the leading edge of a sheet of recording paper enters the secondary transferring portion to when the application of the leading edge portion bias is ended (when application of center portion voltage is started), the secondary transfer bias is linearly changed (increased) (FIG. 12). Similarly, from when the application of the trailing edge portion bias (weak bias) is started, to when the trailing edge of the sheet comes out of the secondary transferring portion, the secondary transfer bias is linearly changed (reduced) (FIG. 12).

10. Deciding of Value for Center Portion Bias

Next, the method for deciding the value for the center portion bias with the use of the test chart 1 is described.

In terms of the secondary scan direction, the test chart 1 has six center portion test images for each of the four colors, which are different in the strength of the secondary transfer bias. Further, the central portion test images (toner images) on the intermediary transfer belt 7 are made up of layered two monochromatic toner images which are different in color. If the secondary transfer bias is weak, it is impossible to completely transfer the toner particles in the layered two toner images, onto a sheet of recording paper. Between the layered two toner images on the intermediary transfer belt 7, it is the one which will be farther from the surface of the sheet P after the secondary transfer (toner image closer to intermediary transfer belt 7), that is more likely to be affected by the incomplete secondary transfer. That is, in this embodiment, the more upstream is the image forming portion S in which a toner image is formed, the more likely for the toner image to be affected by the incomplete secondary transfer.

Table 1 is a summary of the color deviation which occurs to the central portion test image if the incomplete transfer occurs. Further, the left side of FIG. 7 shows the direction of the color deviation, on the a-b chromaticity coordinate, which occurs if the incomplete transfer occurs.

TABLE 1

| | Red | Green | Blue |
|---|---|---|---|
| Secondary transfer bias | Yellow is not transferred onto magenta | Yellow is not transferred onto cyan | Magenta is not transferred onto cyan |
| Lab property (target chromaticity coordinate) | Discriminated on b<br>Red: b is high<br>Magenta: b is low | Discriminated on b<br>Green: b is high<br>Cyan: b is low | Discriminated on a<br>Blue: a is high<br>Cyan: a is low |

Figure 7:
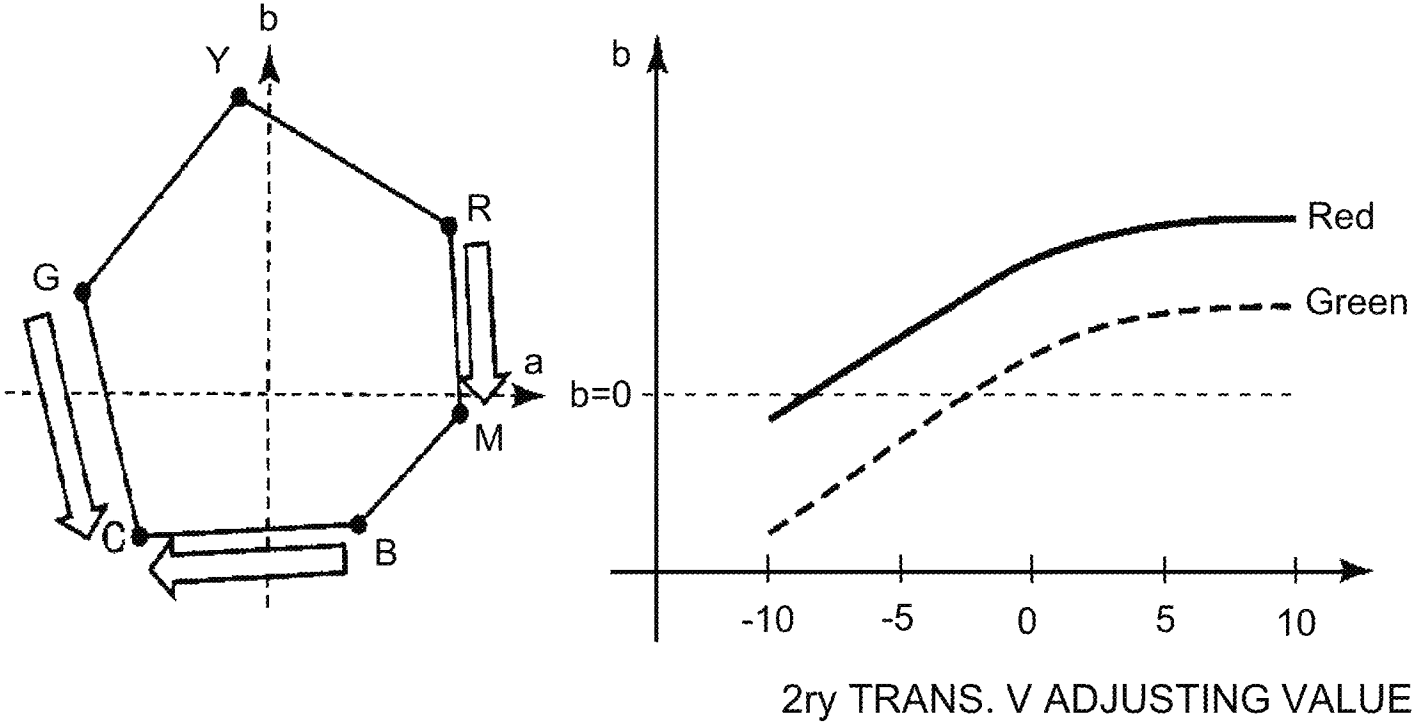
FIG. 7 is a drawing for describing the relationship between the transferability of a toner image of the secondary color, and chromaticity of the toner image.

As the second transfer bias is weakened, the central portion test images R, G and B deviate in color in the direction indicated by an arrow mark in the left side of FIG. 7. Therefore, the sensitivity of the color of the central portion test image to the value (adjustment value) for the secondary transfer bias can be grasped by plotting the values of a or b on the vertical axis, and the value (adjustment value) of the secondary transfer bias on the horizontal axis. The value (adjustment value) for the center portion bias can be decided using this sensitivity as an index.

The right side of FIG. 7 is a graph which shows the chromatic sensitivity of the central portion test images R and G to the value (adjustment value) of the secondary transfer bias, with the value of b plotted on vertical axis. In this embodiment, the maximum and minimum values on a target chromaticity coordinate (value of b for Red, value of b for Green, and value of a for Blue), are to be grasped within the adjustment range for the secondary transfer bias. Then, the value (adjustment value) for the secondary transfer bias, which makes the rate of change of the value on the target chromaticity coordinate, relative to the change of the value (adjustment value) for the secondary transfer bias is obtained. Then, this value (adjustment value) for the secondary transfer bias value is used as the value (adjustment value) for the center portion bias.

Figure 8:
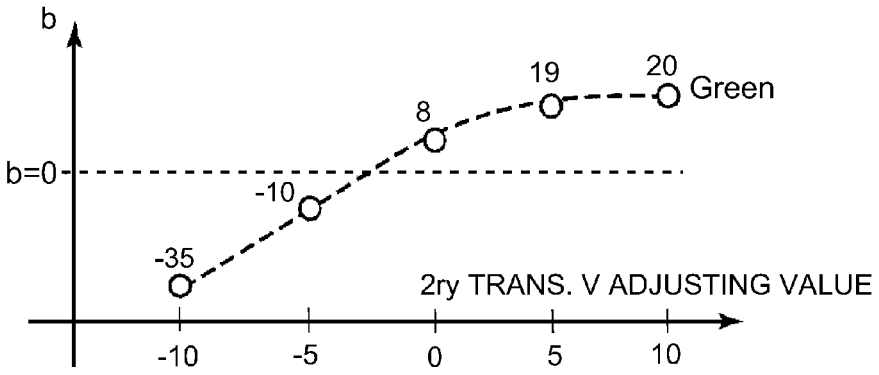
FIG. 8 is a drawing for describing the transferability of a toner image of the secondary color, and the method for deciding the value for the secondary transfer bias.
Figure 8:
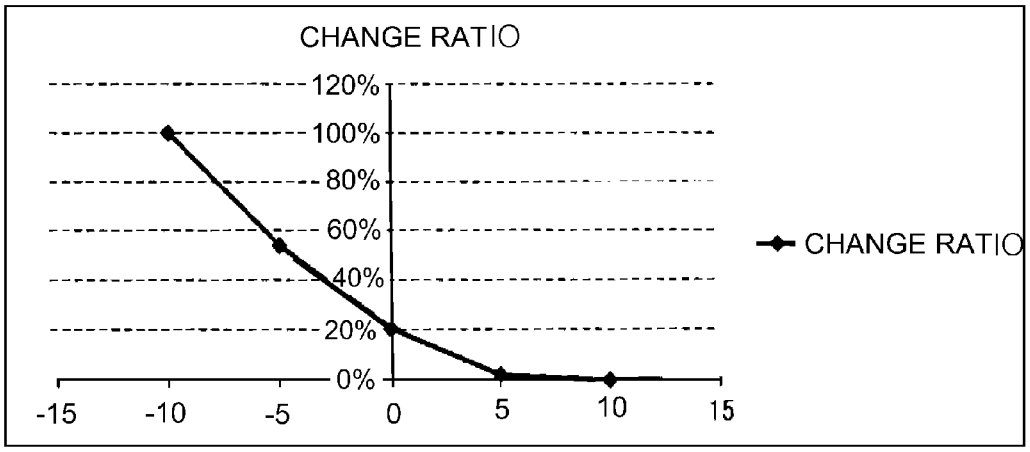

To describe further, FIG. 8 shows the method for deciding the value for the center portion bias for the central portion test image for Green. First, the measured maximum and minimum values of b within the adjustment range for the secondary transfer bias are grasped. Then, the difference (maximum difference) between the measured maximum and minimum values is obtained. Further, the difference between each of the measurement values and the maximum value, on b, is obtained. Further, the ratio of each of these differences to the abovementioned maximum difference is obtained. Then, in this embodiment, the value (adjustment value) for the secondary transfer bias, which makes the ratio no more than 2% is obtained. To describe in greater detail, in this embodiment, the smallest value among the values (adjustment values) for the secondary transfer bias, which make the ratio no more than 2% is obtained. However, the value (adjustment value) for the secondary transfer bias, which makes the ratio no more than 2% may be obtained by interpolation or the like method.

The secondary transfer bias value (adjustment value) obtained as described above is the optimum value (adjustment value) for the secondary transfer bias for the central portion test image of each color (Green in the above-described case). In this embodiment, this process is repeated for the three colors, that is, R, G and B, and the value obtained by averaging the optimal values for the three colors is decided as the value for the center portion bias for the sheet of paper to be registered.

As described above, in this embodiment, the strength of the center portion bias is set based on the relationship between the information related to the color of the central portion test image detected by the color sensor 17, and the strength of the transfer bias. In this embodiment, the central portion test image is yielded through the process in which multiple toner images, different in color, layered on a sheet of recording paper are mixed by fixation. The color sensor 17 detects the information about the sensitivity of the toner image which is farthest from the sheet among the multiple toner images which are different in color, to the change in the amount of toner.

11. Point at which Application of Leading Edge Portion Bias is Ended, and Point at which Application of Trailing Edge Portion Bias is Started Next, a method for finding the point at (timing with) which the application of the leading edge portion bias is to be ended, and the point at (timing with) which the application of the trailing edge portion bias is to be started, are described using the test chart 1.

Figure 9:
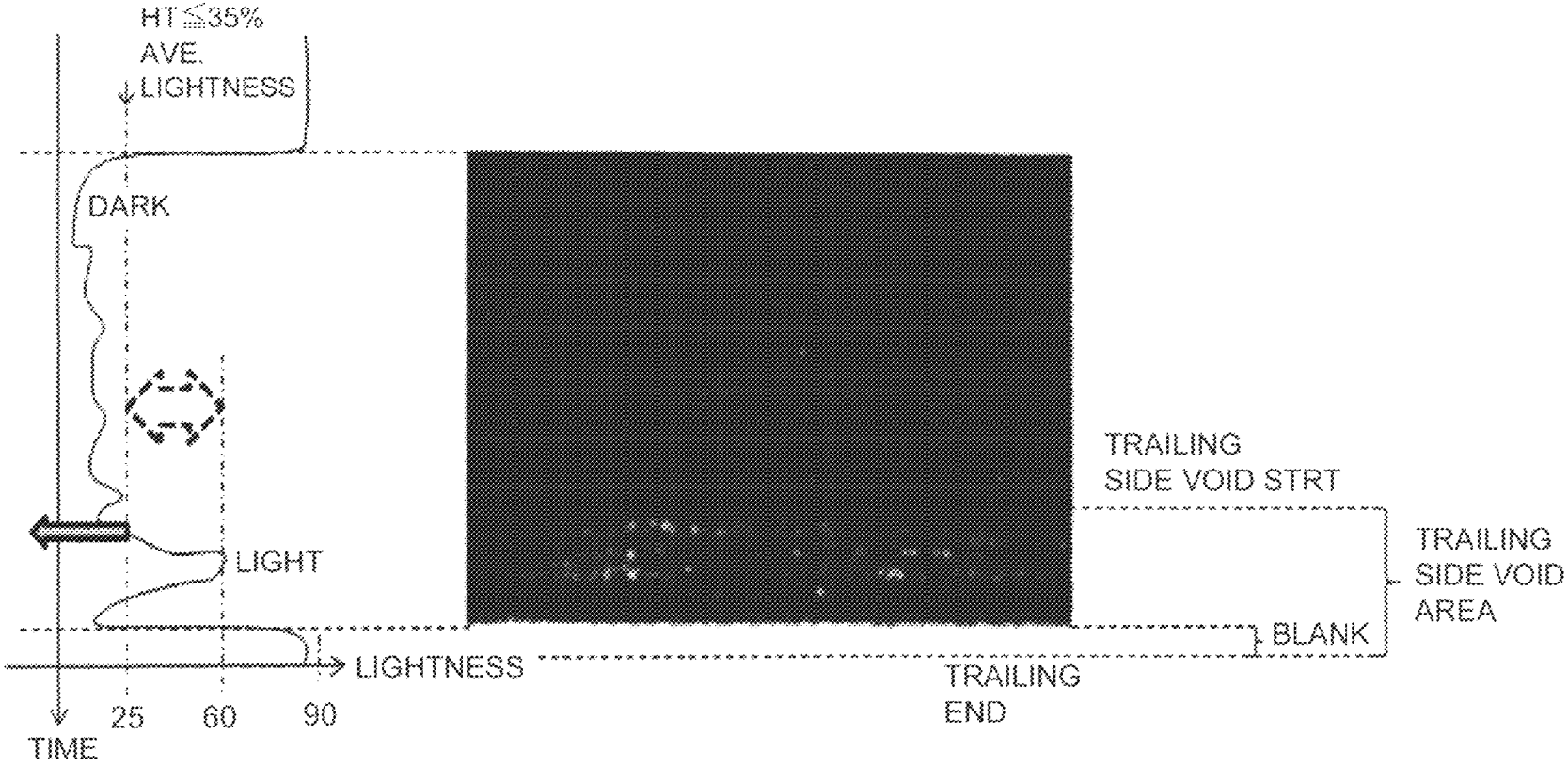
FIG. 9 is a drawing for describing the method for determining the point at which the "transfer blemish" occurs.

The right side of FIG. 9 is an image which has the "transfer blemishes" which occurred to the trailing edge portion of a sheet of cardstock when the test chart 2 was transferred onto the sheet with the use of a secondary transfer bias having the adjustment value of +10. As is evident from FIG. 9, even though the first trailing edge portion test image was formed in halftone (Bk35%), white spots attributable to electrical discharge occurred.

The left side of FIG. 9 is a graph which shows the results of detection of the first trailing edge portion test image in the right side of FIG. 9, detected by the color sensor 17. The vertical axis represents elapsed time, and the horizontal axis represents the luminosity (value of L). First, the average luminosity of the first trailing edge portion test image which is black in color and 35% in tone, is calculated (vertical dotted line), and the point (timing) at which the luminosity exceeds the average luminosity is grasped as the point (timing) at which the occurrence of "transfer blemish" began. Then, this point (timing) is decided as the point (timing) at which the application of the trailing edge portion bias is to be started.

Similarly, for the first leading edge portion test image, the point (timing) at which the luminosity exceeds the average luminosity is grasped as the point (timing) at which the occurrence of the "transfer blemish" ended. Then, this point (timing) is decided as the point (timing) at which the application of the leading edge portion bias is to be ended.

Through the above-described process, it is possible to determine the point (timing) at which the application of the leading edge portion bias is to be ended, and the application of the center portion bias is to be started, and the point (timing) at which the application of the center portion bias is ended, and the application of the trailing edge portion bias is to be started. Whether or not the trailing edge portion bias and trailing edge portion bias are to be applied is decided according to the results of the detection of the test chart 2.

If it is impossible to find the "transfer blemish" in the first leading edge portion test image and first trailing edge portion test image, with the use of the above-described method, the test chart 2 does not need to be formed, and the leading edge portion bias and trailing edge portion bias do not need to be set for a sheet of paper to be used for image formation. Further, if the "transfer blemishes" are found in only one of the first leading edge portion test image and first trailing edge portion test image, the test chart 2 may be formed so that it has only one of the second leading edge portion test image and second trailing edge portion test image, respectively.

By the way, in this embodiment, the point at which the "transfer blemish" begins to occur, and the point at which the occurrence of the "transfer blemish" ends, were determined based on the amount of change of the luminosity from the average luminosity. However, this embodiment is not intended to limit the present invention in scope. For example, the point at which the measured level of luminosity exceeds a preset level of luminosity may be grasped as the point at which the "transfer blemish" begins to occur, and the point at which the occurrence of the "transfer blemish" ends. Further, the luminosity fluctuation (standard deviation)

may be used to determine the point at which the "transfer blemish" began to occur, or ended (for example, the point at which the standard deviation of the measured level of luminosity began to exceed a preset value may be grasped as point at which "transfer blemish" began to occur, or ended). That is, all that is necessary is that the information related to the point (timing) at which the luminosity of the first leading edge portion test image and first trailing edge portion test image exceeds a preset value can be obtained. As described above, in this embodiment, the point at which the application of the leading edge portion bias is to be ended, and the point at which the application of the trailing edge portion bias is to be started, are decided based on the point at which the changes in the information related to the color of the first leading edge portion test image and first trailing edge portion test image, which satisfies preset conditions, are detected by the color sensor 17. In this embodiment, for this process, each of the first leading edge portion test image and first trailing edge portion test image is formed of monochromatic toner. Then, the color sensor 17 is used to detect the information related to brightness (which in this embodiment is luminosity) of the test images.

12. Deciding Value for Leading Edge Portion Bias, and Value for Trailing Edge Portion Bias Next, a method for deciding values for the leading edge portion bias and trailing edge portion bias with the use of the test chart 2 is described.

Five test charts 2 are formed so that they are different in the value for the secondary transfer bias applied to form their second trailing edge portion test image and second trailing edge portion test image. Then, the second trailing edge portion test image and second trailing edge portion test image on each test chart 2 are detected by the color sensor 17. Whether or not the "transfer blemish" occurred can be determined based on the results of this detection by the color sensor 17, with the use of the method which is similar to the method used to find the specific points at which the "transfer blemish" occurred to the first leading edge portion test image, and first trailing edge portion test image. Then, in this embodiment, a value (adjustment value) for the secondary transfer bias for the second trailing edge portion test image, which does not cause the "transfer blemish", and a value (adjustment value) for the secondary transfer bias for the second trailing edge portion test image, which does not cause the "transfer blemish", are independently obtained from each other. To describe in greater detail, the values for the secondary transfer bias, which do not cause the "transfer blemish", are obtained within the secondary transfer bias adjustment range. Then, the largest of these values is chosen as the value (adjustment value for second transfer bias for leading edge portion of sheet), and also, as the value for the leading edge portion bias (adjustment value for second trailing edge portion of sheet). That is, in this embodiment, a value for the secondary transfer bias, which makes the second trailing edge portion test image and second trailing edge portion test image no more than a preset value in luminosity, is obtained. Then, this value is chosen as the value (adjustment value) for the leading edge portion bias and the value (adjustment value) for the trailing edge portion bias.

13. Flow

Figure 10:
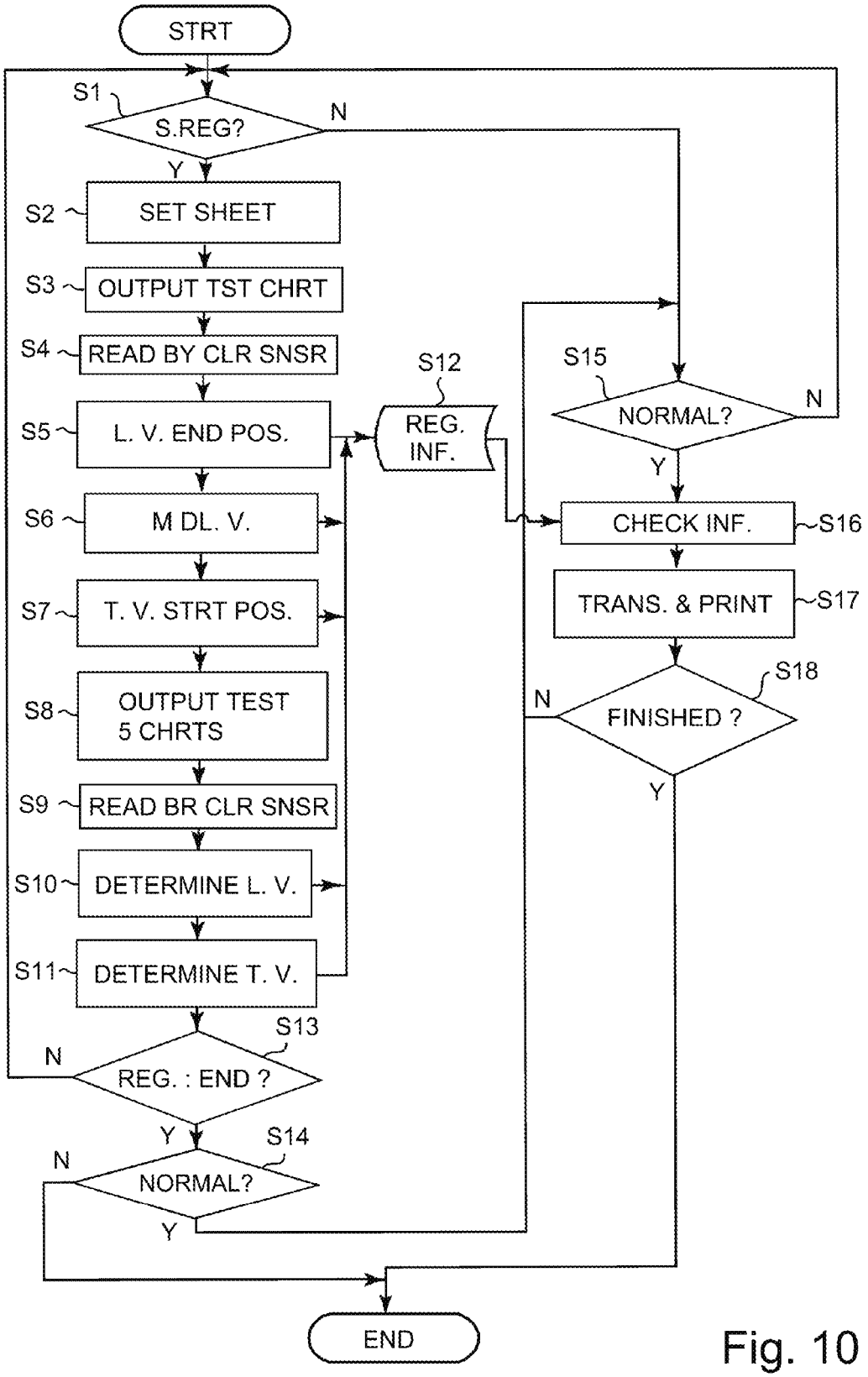
FIG. 10 is a flowchart of the image forming apparatus operation in the adjustment mode.

Next, referring to FIG. 10, the recording medium (paper) registration sequence in this embodiment is described.

As the printer controller 300 receives a command to begin to operate the image forming apparatus 100 in the adjustment mode (as operator selects recording medium (paper) type from the menu on the control panel 180) (S1), the operator is prompted by the control panel 180 to place sheets of paper, which are to be registered, in the sheet feeding portion (S2). Then, the printer controller 300 makes the image forming apparatus 100 output the test chart 1 on one of the new sheets of paper set in the sheet feeding portion (S3). Then, the printer controller 300 reads the test chart 1 with the use of the color sensor 17 (S4). Then, it decides the point at which the application of the leading edge portion bias is to be stopped, by finding the location of the "transfer blemish" on the first leading edge portion test image (S5). Then, it stores this point as the recording medium (paper) registration information (S12). Further, the printer controller 300 decides a value for the center portion bias, by grasping the changes in the color of the central portion test image as described above (S6), and stores this value as recording medium (paper) registration information (S12). Further, the printer controller 300 finds the position of the "transfer blemish" on the first trailing edge portion test image as described above, and determines the point at which the application of the trailing edge portion bias is to be started (S7). Then, it stores this point as recording medium (paper) registration information (S12).

Next, the printer controller 300 makes the image forming apparatus 100 output five test charts 2 on five new sheets of paper, one for one, from the sheet feeding portion (S8). The conditions for the secondary transfer bias are changed according to the timing, and the values for the secondary transfer bias, determined through S5, S6 and S7. Then, the printer controller 300 reads the test charts 2 with the use of the color sensor 17 (S9). Then, the printer controller 300 decides a value for the leading edge portion bias, which does not cause the "transfer blemish", and a value for the trailing edge portion bias, which does not cause the "transfer blemish", as described above, and stores these values as paper registration information (S10, S11 and S12).

Thereafter, the printer controller 300 moves to the next step in response to the command for ending or continuing the paper registration process, inputted through the control panel 180 (S13).

By the way, in a case where the presence of the "transfer blemish" is not confirmed in the first leading edge portion test image and second trailing edge portion test image, in S5 and S7, the printer controller 300 stores, as the paper registration information, that the leading edge portion bias and trailing edge portion bias are not to be set (S12). In this case, the printer controller 300 skips S8-S11, and proceeds to S13.

Further, if the printer controller 300 is instructed, in S14 and S15, to make the image forming apparatus 100 carry out the normal image outputting operation, it refers to the paper registration information (S16), and makes the image forming apparatus 100 output images under one of the above-described secondary transfer bias conditions, which corresponds to the type of the paper selected for the outputting of images (S17 and S18).

As described above, according to this embodiment, as a paper registration command is inputted through the control panel 180 by an operator, the processes of outputting the test chart 1 and test chart 2, detecting the test charts with the use of color sensor 17, deciding the above-described five conditions for the secondary transfer bias, and registering a sheet of recording paper, are automatically carried out. That is, recording medium (paper) is properly registered regardless of operator skill. In other words, this embodiment makes it easy for an operator to set the transfer biases for an image forming apparatus structured so that the transfer biases for the leading edge portion, central portion, and trailing edge portion of a sheet of recording paper can be individually controlled.

Embodiment 2

Next, another embodiment of the present invention is described. The image forming apparatus 100 in this embodiment is the same in basic structure and operation as the image forming apparatus 100 in the first embodiment. Therefore, the elements of the image forming apparatus in this embodiment, which are the same as, or equivalent to, the counterparts of the image forming apparatus in the first embodiment, in function and structure, are given the same referential codes, one for one, as the counterparts, and are not described.

In the first embodiment, the center portion test images for the test chart 1 were formed of secondary color. That is, the method in the first embodiment is such a method that is effective to set the secondary transfer bias for the secondary color.

In comparison, in this embodiment, in addition to test images of the secondary color (first central portion test images), monochromatic toner images (second center portion test images) are formed as the test images for the test chart 1. More specifically, in this embodiment, multiple black toner images which are 35% in tone, are also formed as the central portion test images for the test chart 1, with the use of multiple secondary transfer biases which are different in value. Then, the sensitivity of these second central portion test images to the secondary transfer bias is obtained, and the values for the second transfer biases for the normal image formation are decided in consideration of the balance between the primary and secondary colors. The following is the detailed description of this embodiment.

Figure 11:
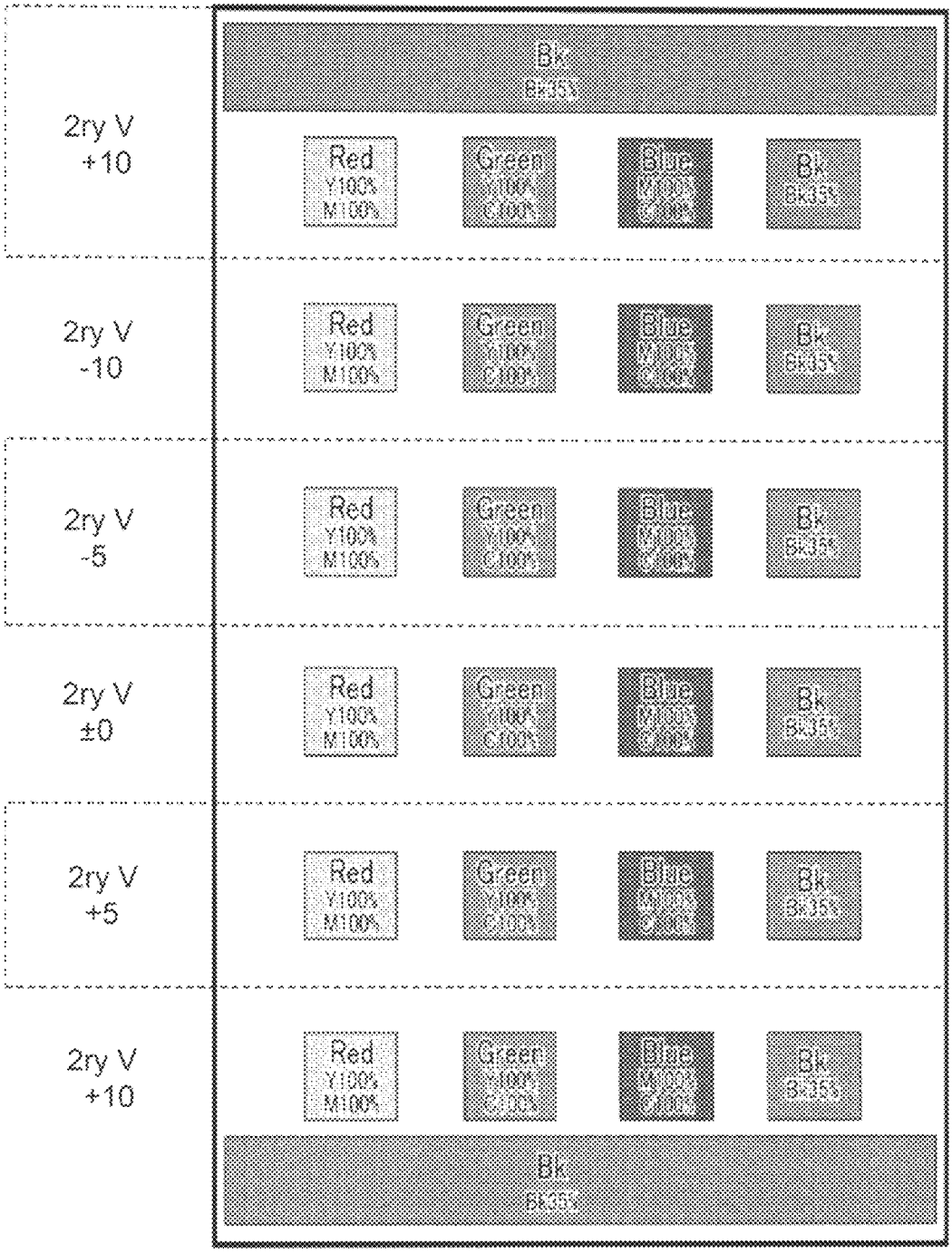
FIG. 11 is a schematic drawing of another example of the test chart 1.

FIG. 11 shows the test chart 1 in this embodiment. The difference between this test chart 1 from the test chart 1 in the first embodiment is that this test chart 1 is provided with the second central portion test images which are black in color and 35% in tone, in addition to the first central portion test images R, G and B which are different in the value for the secondary transfer bias. In this embodiment, these second central portion test images (Bk30%) also are transferred onto a sheet P of recording medium, with the use of the five secondary transfer biases which are different in condition (adjustment value) like the first center portion test images in the first embodiment, and the information related to their color is detected by the color sensor 17.

Like in the first embodiment, in the case of the secondary colors R, G and B), their sensitivity to the secondary transfer bias is grasped based on the value of a or b. In comparison, in the case of the primary color (Bk35%), its sensitivity to the secondary transfer bias is grasped based on the value of L (luminosity).

It is not always true that the stronger the secondary transfer bias, the better the transfer. For example, in the case of some types of recording medium, the "transfer blemish" occurs to the center portion of a sheet of recording paper, as it does to the leading edge portion and/or trailing edge portion of the sheet. More specifically, in the case of a toner image of the secondary color (R, G or B), the stronger the secondary transfer bias, the better the transfer. However, if the secondary transfer bias is excessively strong, such "transfer blemishes" as those shown in the right side of FIG. 9 sometimes occurs to a toner image of the primary color (Bk35%).

Therefore, in this embodiment, the presence or absence of the "transfer blemish" in the second central portion test images of the test chart 1 is determined based on the results of detection by the color sensor 17. The method used in this embodiment for the determination is the same as the method used in the first embodiment to determine the presence or absence of the "transfer blemish".

Then, the value (adjustment value) for the secondary transfer bias, which is excellent for the secondary color (R, G and B) transfer efficiency, and does not cause the "transfer blemish" to a toner image of the primary color (Bk35%), is registered as the value (adjustment value) for the center portion bias. For example, in the first embodiment, a value for the secondary transfer bias, which is necessary and sufficient for satisfactorily secondary transfer is obtained for each of the colors R, G and, B, and the average of the thus obtained values was used as the value (adjustment value) for the center portion bias. In comparison, in this embodiment, a value obtained by averaging the values for the secondary transfer biases for the colors R, G and B, and also, the value for the secondary transfer bias for the toner image (Bk35%), which was obtained as a value which does not cause the "transfer blemish", can be set as the value (adjustment value) for the center portion bias, or a value for the secondary transfer bias, which was obtained as such a value that does not cause the "transfer blemish" to the toner image Bk35%, may be set as the highest value for the average of the values (adjustment values) for the secondary transfer biases, which are necessary and sufficient to satisfactory transfer of the test images of colors R, G and B. In such a case, if this average value exceeds this highest value, the highest value is chosen as the value (adjustment value) for the center portion bias.

As described above, not only can this embodiment provide the same effects as those provided by the first embodiment, but also, can make it easier for an operator to put into consideration, the transferability of a black halftone image when registering a sheet of recording medium (paper) to be used for image formation.

[Miscellanies]

In the foregoing, the present invention was described with reference to the embodiments of the present invention. However, the preceding embodiments are not intended to limit the present invention in scope.

In the embodiments described above, the image forming apparatus 100 was structured so that the test images formed on a sheet of recording medium (paper) are automatically read by a color sensor. However, these embodiments are not intended to limit the present invention in scope. For example, such an arrangement may be made that as a sheet of recording medium on which test images were formed is outputted from an image forming apparatus, an operator sets the sheet of recording medium in the original reading device with which the image forming apparatus is provided, and the test images are read by the original reading device.

Further, in the first embodiment, the central portion test image, and the first center portion test image were images of the secondary color. However, these embodiments are not intended to limit the present invention in scope. All that is necessary is that the test images are preferably such images that are relatively high in density (relatively large in toner amount), and can be detected by a color sensor. That is, the color of these test images does not need to be the secondary one. For example, they may have the tertiary or quaternary color; they may be formed of three or more toners which are different in color. Further, it is optional to form these test images with the use of monochromatic toner so that they become greater in the amount of toner than the test images for detecting the "transfer blemish", which will be described later.

Further, the first and second leading edge portion test images, and second trailing edge portion test images, in the first and second embodiments, and the second center portion test images in the second embodiment, were black images which were 35% in tone. However, these embodiments are not intended to limit the present invention in scope. That is, these test images have only to be such that they are preferably halftone images (relatively small in toner amount) and are detectable by a color sensor. That is, they do not need to be black (Bk: primary color) toner images. For example, they may be halftone cyan images (Cyan 35%: monochromatic halftone image), halftone blue images (C25%+M25%: halftone images of secondary color), or the like.

However, it is desired to find the strength for the secondary transfer bias, which does not cause a test image which is formed on the center portion of a sheet of recording medium and is relatively large in the amount of toner, to be incompletely transferred, and does not cause the "transfer blemish" to occur to a test image which is formed on the leading and trailing edge portions (as well as center portion) of a sheet of recording medium and is relatively small in the amount of toner. In the case of an image forming apparatus of the dry electrophotographic type, which employs an ordinary secondary transferring member, the abovementioned test image which is relatively large in the amount of toner is desired to be such a halftone image that the ratio of the sum of the signal values of the abovementioned test images (for detecting occurrence of "transfer blemish") which are relatively small in the amount of toner, relative to the sum of the signal values of the abovementioned test images which are relatively large in the amount of toner, is no more than 30%. That is, if the abovementioned test images which are relatively large in the amount of toner are such solid images of the secondary color and are 200% in tone as in the first embodiment, the sum of the signal values of the abovementioned halftone test images which are relatively small in the amount of toner is desired to be no more than 60%. To describe based on the first embodiment, it is desired that the relationship, in terms of the amount of toner, between the first and second leading edge portion test images, and the central portion test image, or the relationship between the first and second trailing edge portion test images, and the central portion test image, are as described above. Further, to describe based on the second embodiment, the relationship, in terms of the amount of toner, the first center portion test image and second center portion test image, are as described above. As described above, all that is required when deciding the conditions for the secondary transfer bias is to form such test images that are relatively large in the amount of toner and can be detected by a color sensor, and such test images that are relatively small in the amount of toner and can be detected by a color sensor. Thus, it is unnecessary that the abovementioned test images, which are relatively large in the amount of toner, are the same in signal value as C100%+M100% in the first embodiment.

Further, in the above-described embodiments, all of the above-described five conditions (value for leading edge portion bias, point at which the application of the leading edge portion bias is to be ended, value for the center portion bias, point at which the application of the trailing edge portion bias is to be started, and value for the trailing edge portion bias) are set in the adjustment mode (recording medium (paper) registration). However, these embodiments are not intended to limit the present invention in scope. For example, it is possible that a sheet of recording medium which is practically the same as the one which has been registered will be registered. In such a case, the point at which the electrical discharge to the leading edge portion of a sheet of recording medium is made to end, the point at which the electrical discharge to the trailing edge portion of the sheet is made to end, the point at which electrical discharge is made to occur to the sheet, the point at which electrical discharge is made to begin to occur to the leading edge portion of the sheet, and the point at which electrical discharge is made to begin to occur to the trailing edge portion of the sheet are frequently decided based on the relation between the machine (upstream guiding members of secondary transferring portion) and a sheet of recording medium. Therefore, an image forming apparatus may be structured so that in a case a sheet of recording medium which is similar in property to a sheet of recording medium which has been registered, the step for calculating the point at which the application of the leading edge portion bias is to be started, and the point at which the application of the trailing edge portion bias is to be started, can be skipped to reduce the apparatus in the length of time for computation. However, the strength of the leading edge portion bias, and the strength of the trailing edge portion bias, are affected by the environment in which an image forming apparatus is placed, and the condition of the apparatus. Therefore, they are desired to be decided each time a sheet of recording medium is registered.

According to the present invention, an image forming apparatus is structured so that each of the transfer biases for the leading edge portion, center portion, and trailing edge portion of a sheet of recording medium can be easily set according to the type of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-198727 filed on Oct. 6, 2015, which is hereby incorporated by reference herein in its entirety.

What is claimed is:

1. An image forming apparatus comprising:

an image bearing member configured to carry a toner image;

a toner image forming device configured to form a toner image on said image bearing member;

a transferring device configured to transfer the toner image from said image bearing member onto a recording material at a transfer portion;

a transfer bias applying device configured to apply a leading end bias to the transferring device when a leading end side area of the recording material with respect to a feeding direction of the recording material is passing through the transfer portion and apply a central bias to the transferring device when a central area of the recording material with respect to the feeding direction is passing through the transfer portion;

a fixing device configured to fix the toner image transferred onto the recording material on the recording material;

a sensor configured to detect light projected to and reflected by the toner image fixed on the recording material by said fixing device; and a controller configured to control the leading end bias and the central bias so that the leading bias is lower than the central bias, wherein said controller sets a condition of the leading end bias on the basis of a detection result of said sensor from a first test image formed by the toner image forming device, and sets a condition of the central bias on the basis of a detection result of said sensor from a second test image formed by the toner image forming device, and wherein a toner deposition amount per unit area of the first test image is less than that of the second test image.

2. An apparatus according to claim 1, wherein the first test image is a monochromatic half-tone image, and the second test image is a high order color image.

3. An apparatus according to claim 1, wherein the condition of the leading end bias is a position of the recording material with respect to the feeding direction at which the leading end bias is applied, or an intensity of the leading end bias.

4. An apparatus according to claim 1, wherein when a detection result of said sensor from the first test image exhibits a change satisfying a predetermined condition, said controller sets a position with respect to the feeding direction at which the leading end bias is applied.

5. An apparatus according to claim 1, wherein said controller outputs a chart including the first and second test images, wherein the first test image is formed on a leading end side area of the chart with respect to the feeding direction, and wherein the second test image is formed on a central area of the chart with respect to the feeding direction.

6. An image forming apparatus comprising:

an image bearing member configured to carry a toner image;

a toner image forming device configured to form the toner image on said image bearing member;

a transferring device configured to transfer the toner image from said image bearing member onto a recording material at a transfer portion;

a transfer bias applying device configured to apply a trailing end bias to the transferring device when a trailing end side area of the recording material with respect to a feeding direction of the recording material is passing through the transfer portion and apply a central bias to the transferring device when a central area of the recording material with respect to the feeding direction is passing through the transfer portion;

a fixing device configured to fix the toner image transferred onto the recording material on the recording material;

a sensor configured to detect light projected to and reflected by the toner image fixed on the recording material by said fixing device; and a controller configured to control the trailing end bias and the central bias so that the trailing end bias is lower than the central bias, wherein said controller sets a condition of the trailing end bias on the basis of a detection result of said sensor from a first test image formed by the toner image forming device, and sets a condition of the central bias on the basis of a detection result of said sensor from a second test image by the toner image forming device, and wherein a toner deposition amount per unit area of the first test image is less than that of the second test image.

7. An apparatus according to claim 6, wherein the first test image is a monochromatic half-tone image, and the second test image is a high order color image.

8. An apparatus according to claim 6, wherein the condition of the trailing end bias is a position of the recording material with respect to the feeding direction at which the trailing end bias is applied, or an intensity of the trailing end bias.

9. An apparatus according to claim 6, wherein when a detection result of said sensor from the first test image exhibits a change satisfying a predetermined condition, said controller sets a position with respect to the feeding direction at which the trailing end bias is applied.

10. An apparatus according to claim 6, wherein said controller outputs a chart including the first and second test images, wherein the first test image is formed on a leading end side area of the chart with respect to the feeding direction, and wherein the second test image is transferred under different transfer conditions and is formed on a central area of the chart with respect to the feeding direction.

11. An image forming apparatus comprising:

an image bearing member configured to carry a toner image;

a toner image forming device configured to form the toner image on said image bearing member;

a transferring device configured to transfer the toner image from said image bearing member onto a recording material at a transfer portion;

a transfer bias applying device configured to apply a leading end bias to the transferring device when a leading end side area of the recording material with respect to a feeding direction of the recording material is passing through the transfer portion and apply a central bias to the transferring device when a central area of the recording material with respect to the feeding direction is passing through the transfer portion; and a controller configured to control the leading end bias to be smaller than the central bias, wherein said controller executes an operation in a test chart outputting mode for outputting a predetermined test image for setting a condition of the leading end bias onto a test chart.

12. An apparatus according to claim 11, wherein in the operation in the test chart outputting mode, said controller outputs a plurality of second test images transferred under different transfer conditions by the transferring device for adjusting the central bias.

13. An apparatus according to claim 11, wherein the predetermined test image is a monochromatic half-tone image.

14. An apparatus according to claim 11, wherein said controller outputs the predetermined test image and a second predetermined test image for adjusting the central bias.

15. An apparatus according to claim 11, wherein said controller outputs a second predetermined test image for adjusting the central bias, and wherein the predetermined test image has a first toner amount per unit area, wherein the second predetermined test image has a second toner amount per unit area, and wherein the second toner amount per unit area is greater than the first toner amount per unit area.

16. An apparatus according to claim 15, wherein the predetermined test image is a monochromatic half-tone image, and the second predetermined test image is a high order color image.

17. An apparatus according to claim 11, further comprising a sensor configured to detect light projected to and reflected by the predetermined test image on the test chart, wherein said controller controls the condition of the leading end bias on the basis of detection result of said sensor from the predetermined test image.

18. An apparatus according to claim 11, wherein the condition of the leading end bias includes a position of the recording material with respect to the feeding direction at which the leading end bias is applied, or an intensity of the leading end bias.

19. An apparatus according to claim 11, wherein said controller outputs a second predetermined test image for adjusting the central bias, wherein the predetermined test image is formed on a leading end side area of the test chart with respect to the feeding direction, and wherein the second predetermined test image is formed on a central area of the test chart with respect to the feeding direction.

20. An image forming apparatus comprising:

an image bearing member configured to carry a toner image;

a toner image forming device configured to form the toner image on said image bearing member;

a transferring device configured to transfer the toner image from said image bearing member onto a recording material at a transfer portion;

a transfer bias applying device configured to apply a trailing end bias to the transferring device when a trailing end side area of the recording material with respect to a feeding direction of the recording material is passing through the transfer portion and apply a central bias to the transferring device when a central area of the recording material with respect to the feeding direction is passing through the transfer portion; and a controller configured to control the trailing end bias to be lower than the central bias, wherein said controller executes an operation in a test chart outputting mode for outputting a predetermined test image for setting a condition of the trailing end bias onto a test chart.

21. An apparatus according to claim 20, wherein in the operation in the test chart outputting mode, said controller outputs a plurality of second predetermined test images transferred under different transfer conditions by the transferring device for adjusting the central bias.

22. An apparatus according to claim 20, wherein the predetermined test image is a monochromatic half-tone image.

23. An apparatus according to claim 20, wherein said controller outputs the predetermined test image and a second predetermined test image for adjusting the central bias.

24. An apparatus according to claim 20, wherein said controller outputs a second predetermined test image for adjusting the central bias, and wherein the predetermined test image has a first toner amount per unit area, wherein the second predetermined test image has a second toner amount per unit area, and wherein the second toner amount per unit area is greater than the first toner amount per unit area.

25. An apparatus according to claim 24, wherein the predetermined test image is a monochromatic half-tone image, and the second predetermined test image is a high order color image.

26. An apparatus according to claim 20, further comprising a sensor configured to detect light projected to and reflected by the predetermined test image on the test chart, wherein said controller controls the condition of the trailing end bias on the basis of a detection result of said sensor from the predetermined test image.

27. An apparatus according to claim 20, wherein the condition of the trailing end bias includes a position of the recording material with respect to the feeding direction at which the trailing end bias is applied, or an intensity of the trailing end bias.

28. An apparatus according to claim 20, wherein said controller outputs a second predetermined test image for adjusting the central bias, wherein the predetermined test image is formed on a trailing end side area of the test chart with respect to the feeding direction, and wherein the second predetermined test image is formed on a central area of the test chart with respect to the feeding direction.

29. An image forming apparatus comprising: an image bearing member configured to carry a toner image; a toner image forming device configured to form the toner image on said image bearing member;

a transferring device configured to transfer the toner image from said image bearing member onto a recording material at a transfer portion;

a transfer bias applying device configured to apply a trailing end bias to the transferring device when a trailing end side area of the recording material with respect to a feeding direction of the recording material is passing through the transfer portion and apply a central bias to the transferring device when a central area of the recording material with respect to the feeding direction is passing through the transfer portion; and a controller configured to control the trailing end bias to be lower than the central bias, wherein said controller executes an operation in a test chart outputting mode for outputting a predetermined test image formed on a trailing end of a maximum image forming area of the test chart.

30. An apparatus according to claim 29, wherein the predetermined test image is a half-tone image.

31. An apparatus according to claim 29, wherein the predetermined test image is formed on the test chart in the form of a long and narrow rectangle.

32. An image forming apparatus comprising:

an image bearing member configured to carry a toner image;

a toner image forming device configured to form the toner image on said image bearing member;

a transferring device configured to transfer the toner image from said image bearing member onto a recording material at a transfer portion;

a transfer bias applying device configured to apply a leading end bias to the transferring device when a leading end side area of the recording material with respect to a feeding direction of the recording material is passing through the transfer portion and apply a central bias when a central area of the recording material with respect to the feeding direction is passing through the transfer portion; and a controller configured to control the leading end bias to be lower than the central bias, wherein said controller executes an operation in a test chart outputting mode for outputting a predetermined test image formed on a leading end of a maximum image forming area of the test chart.

* * * * *